US005988749A

United States Patent [19]

Williams

[11] Patent Number: 5,988,749

[45] Date of Patent: Nov. 23, 1999

[54] COUCH WITH SLIDING SEAT

[75] Inventor: James A. Williams, Galion, Ohio

[73] Assignee: Absolute Comfort, Inc., Galion, Ohio

[21] Appl. No.: 08/914,459

[22] Filed: Aug. 19, 1997

Related U.S. Application Data

[63] Continuation-in-part of application No. 08/708,406, Sep. 4, 1996.

[51] Int. Cl.[6] ..... A47C 1/02

[52] U.S. Cl. ..... 297/337; 5/18.1

[58] Field of Search ..... 5/12.1, 17, 18.1; 297/337, 342, 311, 118

[56] References Cited

U.S. PATENT DOCUMENTS

| | | |
|---|---|---|
| 711,412 | 10/1902 | Archambeault . |
| 871,022 | 11/1907 | Anthony . |
| 1,414,637 | 5/1922 | Gell . |
| 2,025,436 | 12/1935 | Brosset . |
| 2,351,222 | 6/1944 | Muskin et al. . |
| 2,497,385 | 2/1950 | Cramer, Sr. . |
| 2,642,584 | 6/1953 | Petersen et al. . |
| 2,860,691 | 11/1958 | Caesar . |
| 3,005,997 | 10/1961 | Fox . |
| 3,235,308 | 2/1966 | Conner . |
| 3,299,446 | 1/1967 | Blise et al. . |
| 3,331,408 | 7/1967 | Sarvas . |
| 3,458,877 | 8/1969 | Edwards . |
| 3,567,280 | 3/1971 | Bradshaw . |
| 3,816,860 | 6/1974 | Quakenbush . |
| 3,913,152 | 10/1975 | Quakenbush . |
| 4,001,901 | 1/1977 | Quakenbush . |
| 4,037,872 | 7/1977 | Quakenbush . |
| 4,166,299 | 9/1979 | DuShane et al. . |
| 4,452,486 | 6/1984 | Zapf et al. . |
| 4,481,684 | 11/1984 | Hauck . |
| 4,563,784 | 1/1986 | Shrock et al. . |
| 4,586,206 | 5/1986 | Singer . |
| 4,733,845 | 3/1988 | Maiwald . |
| 4,756,034 | 7/1988 | Stewart . |
| 5,098,158 | 3/1992 | Palarski . |
| 5,292,178 | 3/1994 | Loose et al. . |
| 5,575,449 | 11/1996 | Shinbori et al. . |
| 5,575,535 | 11/1996 | Burchett et al. . |
| 5,607,204 | 3/1997 | Gryp . |

*Primary Examiner*—Milton Nelson, Jr.
*Attorney, Agent, or Firm*—Fay, Sharpe, Fagan, Minnich & McKee, LLP

[57] ABSTRACT

A seating unit, such as a sofa, chair or love seat with a movable seat section includes a main frame arranged for support of a back rest in fixed relation thereto and a seat frame for supporting a seat. Support tracks slidably support the seat frame from the main frame. The seat frame can be moved from a retracted position to an extended position in relation to the main frame. A locking device secures the seat frame in relation to the main frame in a plurality of positions between the retracted position and the extended position. Several different seat frame embodiments are disclosed. In addition, a unique cable-based actuation assembly is described.

20 Claims, 29 Drawing Sheets

10C
10C
210
216
214
212

218
216
220

10B
10B

E
214
212
210

COUCH WITH SLIDING SEAT

CROSS REFERENCE TO RELATED APPLICATION

This application is a continuation in part of U.S. application Ser. No. 08/708,406 filed Sep. 4, 1996 entitled "Seating Unit With Movable Seat."

FIELD OF THE INVENTION

This invention pertains to furniture. More particularly, the invention pertains to a seating system, such as a couch, sofa, love seat or chair having a movable seat section.

BACKGROUND OF THE INVENTION

Convertible seat bed units of various constructions and useable both for seating and sleeping are well known in the art. In many of these, a flexible bed platform is held in a curved condition in a sofa portion of the seat bed unit. Once the seat cushions are removed, the bed platform can be slid out of the sofa portion and is straightened out. Convertible sofa-bed units are also known in which a rigid seat support frame is mounted on a main frame for movement of the seat between a rearward seating position—in which a rear edge of the seat is located under a back rest—and a forward sleeping position, in which the rear edge of the seat is located forwardly of the backrest and is raised to level the bed. A typical patent disclosing such an embodiment is the Quakenbush U.S. Pat. No. 3,816,860. Another such sofa-bed unit is disclosed in the Fox U.S. Pat. No. 3,005,997.

In the known art as exemplified by these two patents, the angle at which the seat frame is oriented in relation to a horizontal plane parallel to the floor changes as the seat frame is moved from its seating position to its sleeping position. In the seating position, the seat frame is disposed at an acute angle to a horizontal plane. In the sleeping position, the seat frame is disposed in the horizontal plane. The angle of the seat frame changes because it is desirable, when the seat frame is used for sleeping, to have the seat frame be parallel to the floor surface, and hence the horizontal plane, so that a person sleeping on the seat frame of the sofa-bed does not roll off the seat frame or roll into the backrest of the sofa. In contrast, in a normal seated position, it is desirable to position the seat frame at an acute angle to the horizontal so that a seated person does not slide off the sofa. To this end, the seat frame is normally tilted in relation to a horizontal plane by approximately 1° to 3° or so.

One of the problems with conventional couches and seats is that for a person with long legs, the seat portion of the couch or chair is usually not long enough to support all of the thigh of the person so that the backs of the knees are supported by the seat cushions. If the known sofa-bed units disclosed in the Quakenbush '860 patent and the Fox '997 patents were to have their seat frames moved forward, this would accommodate the legs of longer persons. However, the orientation of the seat frames would be changed from an acute angle to the horizontal—which is desirable when sitting—to the horizontal plane. This orientation is uncomfortable for seated persons as they would have a tendency to slide off the seat frame.

Another problem with conventional couches and seats is that the extension of the seat frame in relation to the main frame cannot be controlled so that the seat frame can be locked in relation to the main frame at a number of positions between a fully retracted position and a fully extended position. Rather, in the sofa-bed units disclosed in the Quakenbush '860 patent and the Fox '997 patent, there is only a fully retracted position and a fully extended position. This is understandable since the thrust of both of these patents is to a sofa which converts into a bed rather than a sofa having a slidable seat section.

In addition, the known sofa-bed units do not allow a sliding motion of the seat frame in relation to the main frame when a person is seated on the seat frame. Rather, the person has to get up to move the seat frame. This is understandable because the seat frame is being turned into a bed.

It would be desirable to have the seat frame which, when slid forwardly, maintains an acute angle in relation to the main frame so that a person sitting on the seat frame can have the backs of his knees supported by the seat cushions while at the same time not having a tendency to slide off the seat cushions because of a change in the orientation of the seat frame in relation to the horizontal plane. It would also be desirable to have a seat frame that can be moved while the person remains seated and that can be locked into a number of positions between a fully retracted position and a fully extended position so that the person can regulate the length of the seat portion.

Accordingly, it has been considered desirable to develop a new and improved seating system which can be used on couches, love seats or chairs which would overcome the foregoing difficulties and others, meet the above stated needs and provide better and more advantageous overall results.

BRIEF SUMMARY OF THE INVENTION

In accordance with the present invention, a seating unit is provided with a movable seat section.

More particularly in accordance with this aspect of the invention, the unit comprises a main frame arranged for support of a backrest and a seat frame for supporting a seat. A support track movably supports the seat frame on the main frame. The support track comprises a first member fixed to the main frame and a second member fixed to the seat frame. The first member cooperates with the second member for moving the seat frame from a retracted position to an extended position in relation to the main frame. A locking means is provided for securing the seat frame in relation to the main frame in a plurality of positions between the retracted position and the extended position.

If desired, the locking means can comprise a plate mounted on the seat frame, the plate comprising a plurality of spaced slots, an arm pivotally mounted on the main frame and adapted to engage one of the slots and a biasing means for urging the arm to one end position in relation to the main frame in order to engage one of the slots. The locking means can further comprise a means for moving the arm away from the plate to allow movement of the rail in relation to the arm. The means for moving can comprise a cable having a first end secured to the arm and a second end and an actuation means to which the cable second end is secured.

If desired, the seat frame can comprise first and second side rails which are spaced from each other, a back rail to a respective end of which a respective first end of the first and second side rails are secured and a front rail spaced from the back rail to which a respective second end of the first and second side rails are secured. An apron can have a first end secured to the main frame and a second end secured to the seat frame back rail.

If desired, a motor can be provided for moving the seat frame in relation to the main frame, the motor being secured to one of the seat frame and the main frame and a means can be operated by the motor for coacting with the other of the seat frame and the main frame. If desired, the means operated by the motor can comprise a screw housing. On the other hand, the means operated by the motor can comprise a sprocket wheel and the seat frame can further comprise an element which cooperates with the sprocket wheel.

The first member of the support track can comprise a first slide member mounted on the main frame along one side of the seat frame and the second member of the support track can comprise a slide member mounted on the seat frame and located parallel to and adjacent to the first slide member so that the second slide member can cooperate with the first slide member. On the other hand, the first member of the support track can comprise a first glide track mounted on the main frame and the second member of the support track can comprise a glide track mounted on the seat frame and located adjacent the first glide track so that the second glide track can cooperate with the first glide track. Preferably, the seat frame is oriented at an acute angle in relation to a horizontal plane in all locations of the seat frame.

One advantage of the present invention is the provision of a new and improved seating unit, such as a sofa, love seat or chair having a movable seat section.

Another advantage of the present invention is the provision of a seating unit having a seat frame which slides in relation to a main frame from a rearward position to a forward position thereby enabling a person seated on the seat frame to lengthen an effective length of the seat so as to allow the backs of the knees of that person to be supported by the forward edge of the seat even if the person's legs would otherwise be too long for this purpose.

Still another advantage of the present invention is the provision of a seating unit having a seat frame which is slidably mounted in relation to a main frame such that the seat frame is oriented at an acute angle in relation to a horizontal plane at all positions of the seat frame.

A further advantage of the present invention is the provision of a seating unit having a seat frame which is movable in relation to a main frame, even when a person is sitting on the seat frame, and a locking means for securing the seat frame in relation to the main frame in a plurality of positions between a retracted position and an extended position.

A yet further advantage of the present invention is the provision of a seating unit having a rigid seat frame which is slidably supported from a main frame on support tracks such as slides or glides.

Still other benefits and advantages of the invention will become apparent to those of average skill in the art upon a reading and understanding of the following detailed specification.

BRIEF DESCRIPTION OF THE DRAWINGS

The invention may take physical form in certain parts and arrangements of parts, several preferred embodiments of which will be described in detail in this specification and illustrated in the accompanying drawings, which form a part hereof and wherein.

DETAILED DESCRIPTION OF THE PREFERRED EMBODIMENTS

Figure 1:
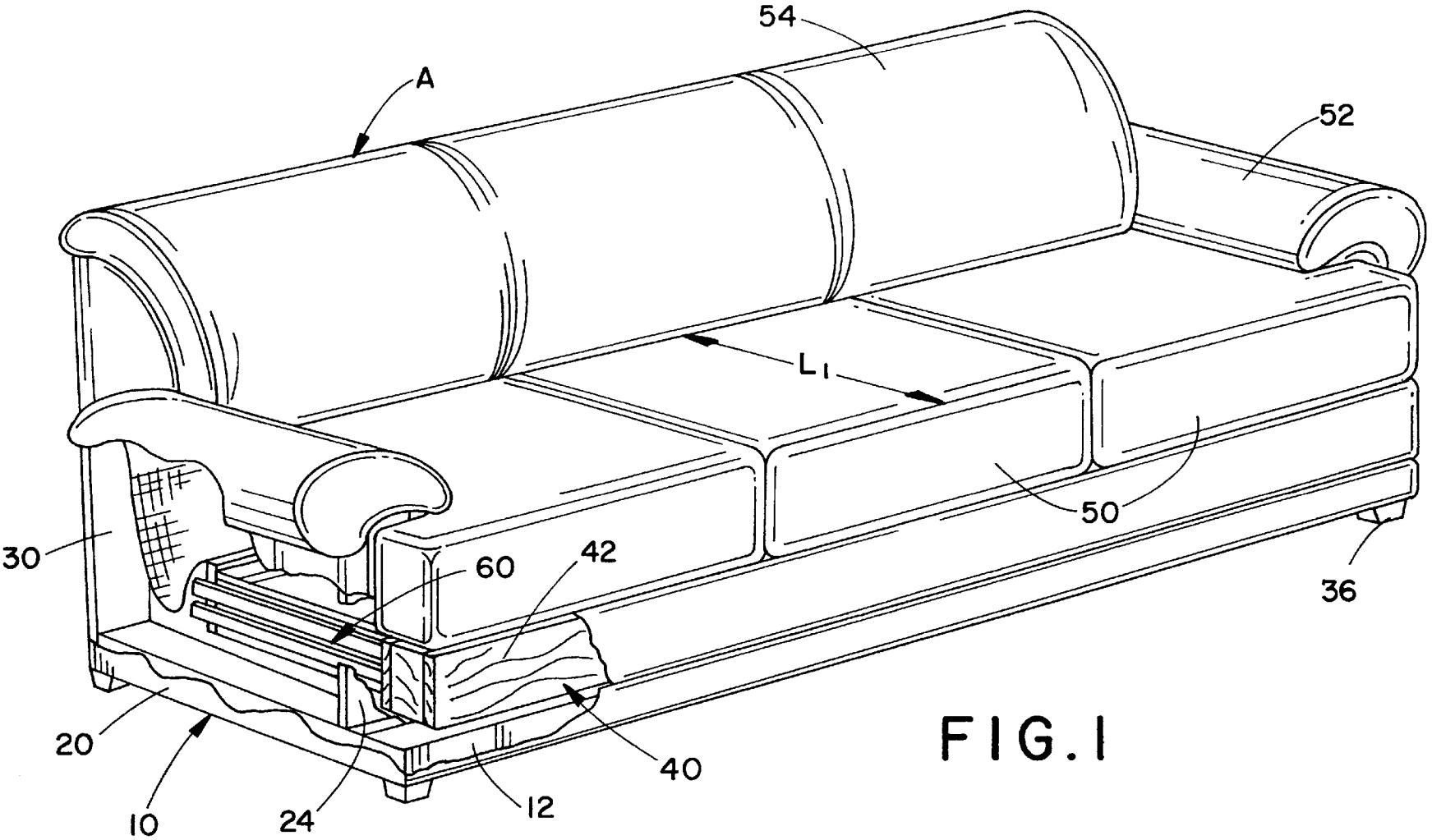
FIG. 1 is a perspective view, partially broken away, of a sofa according to the present invention in a retracted position.
Figure 5:
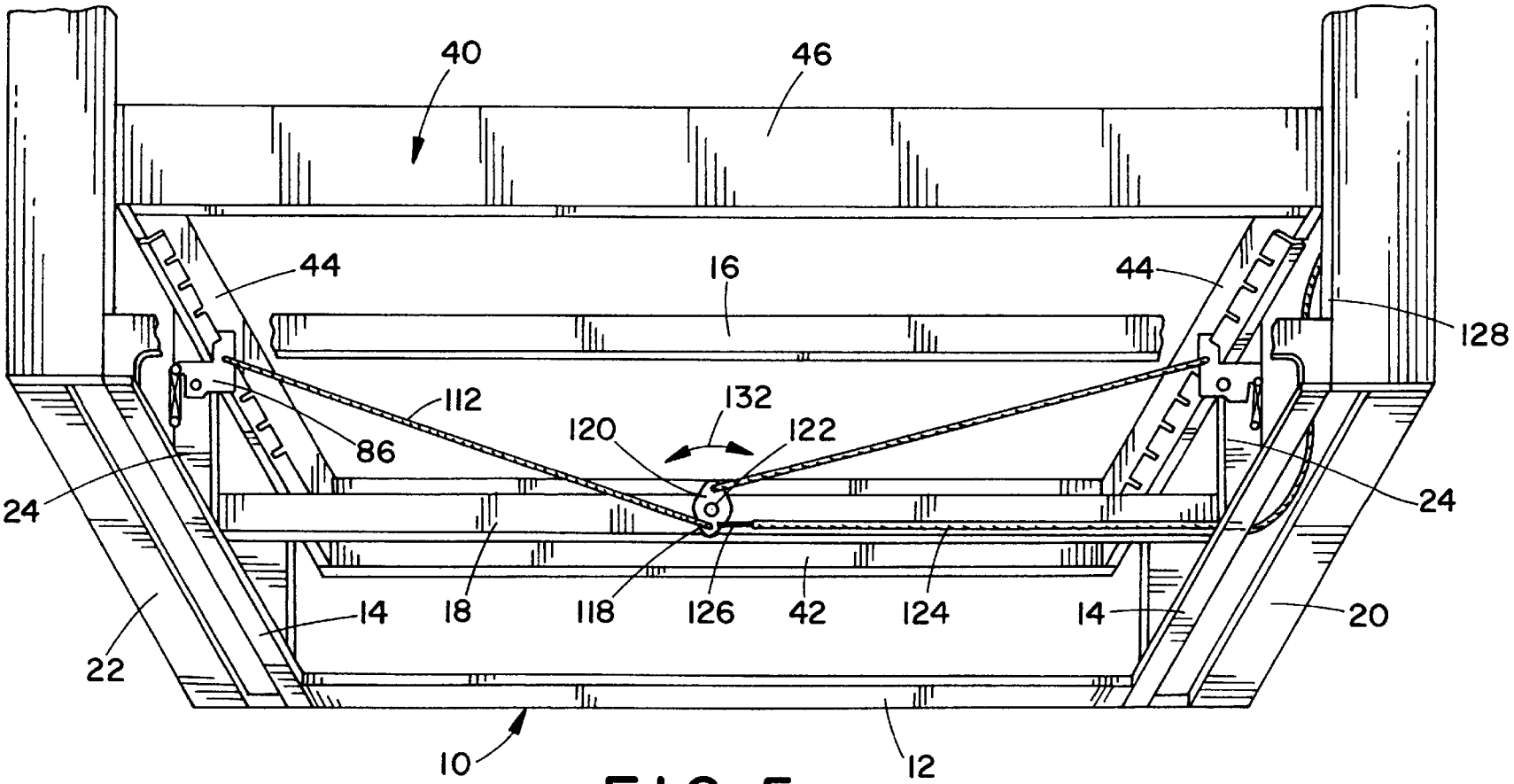
FIG. 5 is a perspective view from the bottom rear of the sofa of FIG. 1 with many portions of the sofa broken away for clarity.

Referring now to the drawings, wherein the showings are for purposes of illustrating several preferred embodiments of the invention only and not for purposes of limiting same, FIG. 1 shows a sofa A according to the present invention. The sofa includes a main frame 10 for supporting a backrest section and a seat section, as well as the arm sections of the sofa. With reference now also to FIG. 5, the main frame 10 comprises a front rail 12, a pair of spaced side rails 14 and a rear rail 16. A central rail 18 extends between the side rails 14 and is positioned between the front and rear rails to stiffen the main frame 10. Secured to a respective side rail 14 are left and right arm support truss members 20 and 22. A vertical brace 24 extends upwardly from each of the side rails 14 such that the central rail 18 is secured thereto. As best illustrated in FIG. 6, a horizontal brace member 26 is secured to each of the left and right arm support trusses 20 and 22.

Figure 3:
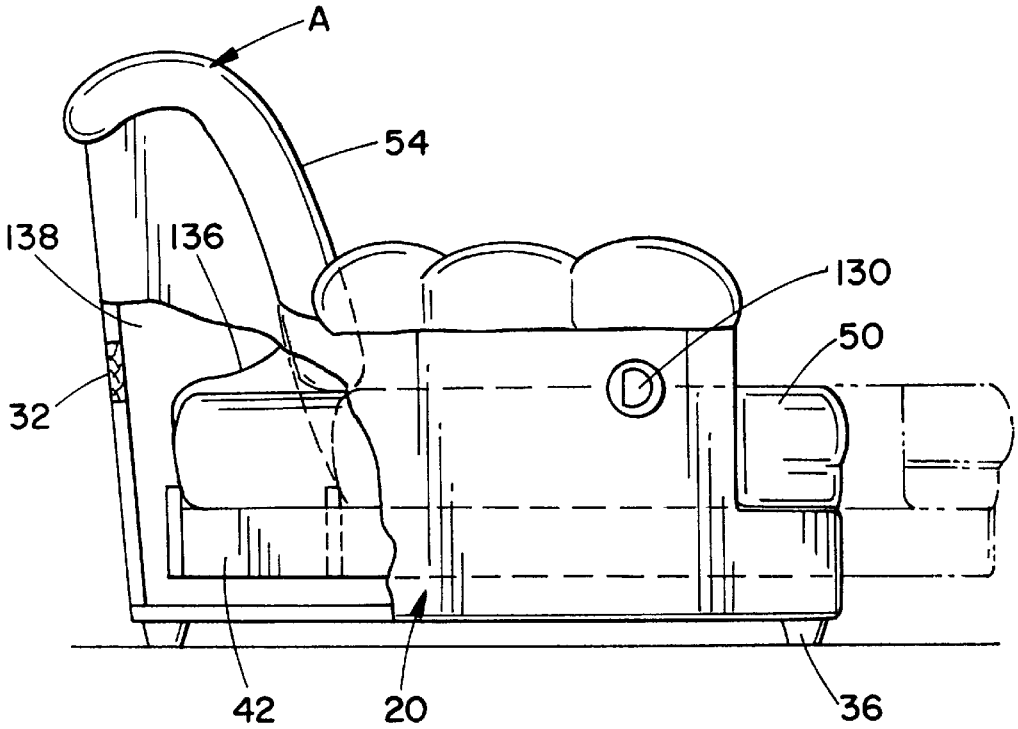
FIG. 3 is a side elevational view, partially broken away, of the sofa of FIG. 1.

With reference now again to FIG. 1, the main frame 10 also has a backrest truss 30 which extends vertically from the rear rail 16. As best shown in FIG. 3, a horizontal brace 32 is fastened between opposing ends of the backrest truss 30 to stiffen same. Normally, a support foot 36 is provided at each corner of the main frame 10 to elevate the sofa A from the subjacent floor surface.

Figure 2:
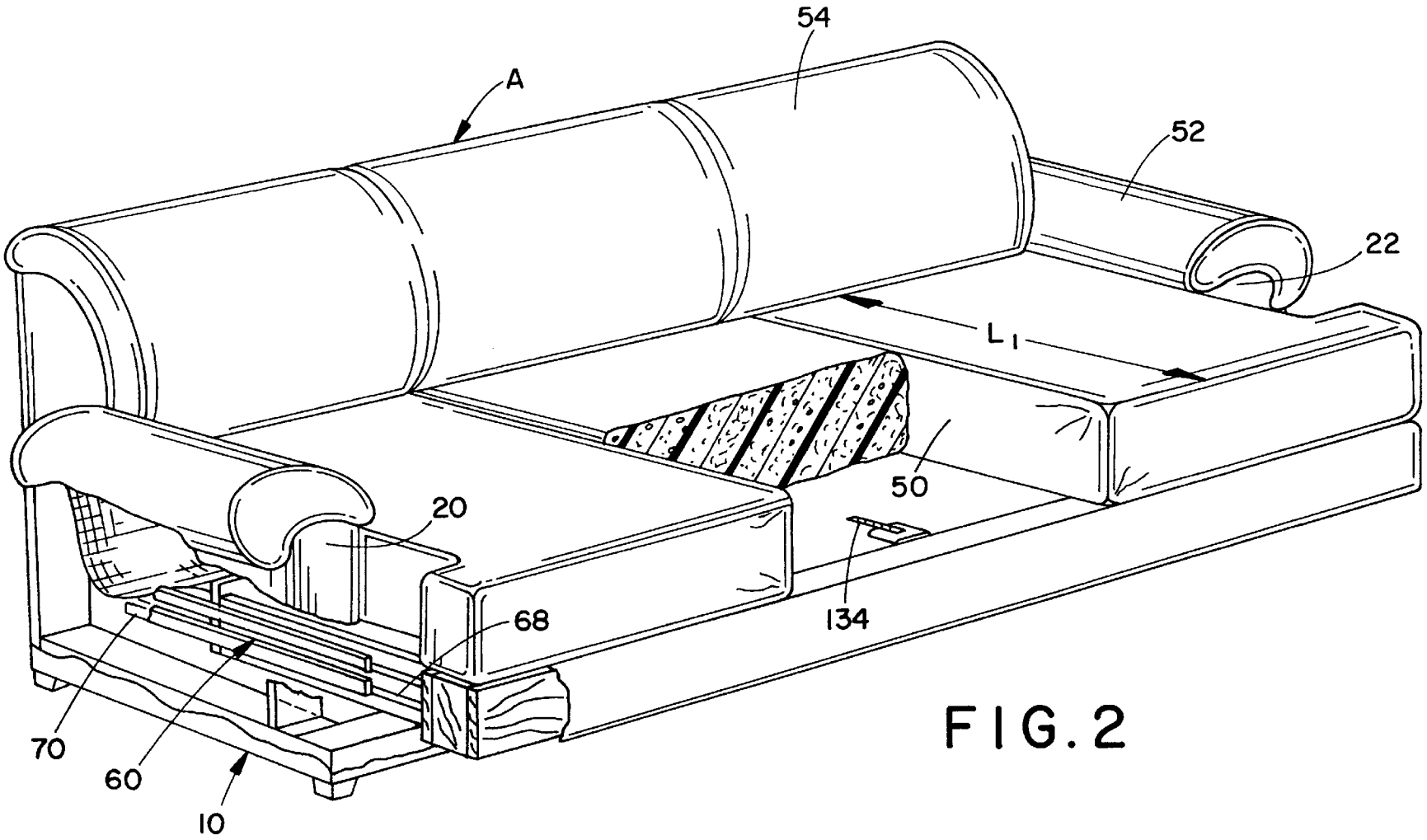
FIG. 2 is a perspective view, partially broken away, of the sofa of FIG. 1 in an extended position.

Slidably mounted on the main frame 10 is a seat frame 40. With reference now again to FIG. 5, the seat frame comprises a front rail 42, a pair of side rails 44 and a rear rail 46 which are all secured together to form a box frame. Supported on the seat frame are a plurality of cushions 50 as illustrated in FIG. 2. It can be seen from FIGS. 1 and 2 that the two end cushions have arms which extend sideways so that they protrude in front of the arm supports 20 and 22. To this end, the seat frame 40 also has lateral extensions to support these portions of the cushions. Arm padding 52 is provided atop the left and right arm supports 20 and 22 and an upholstered back 54 is secured to the backrest section 30 of the main frame 10.

Figure 6:
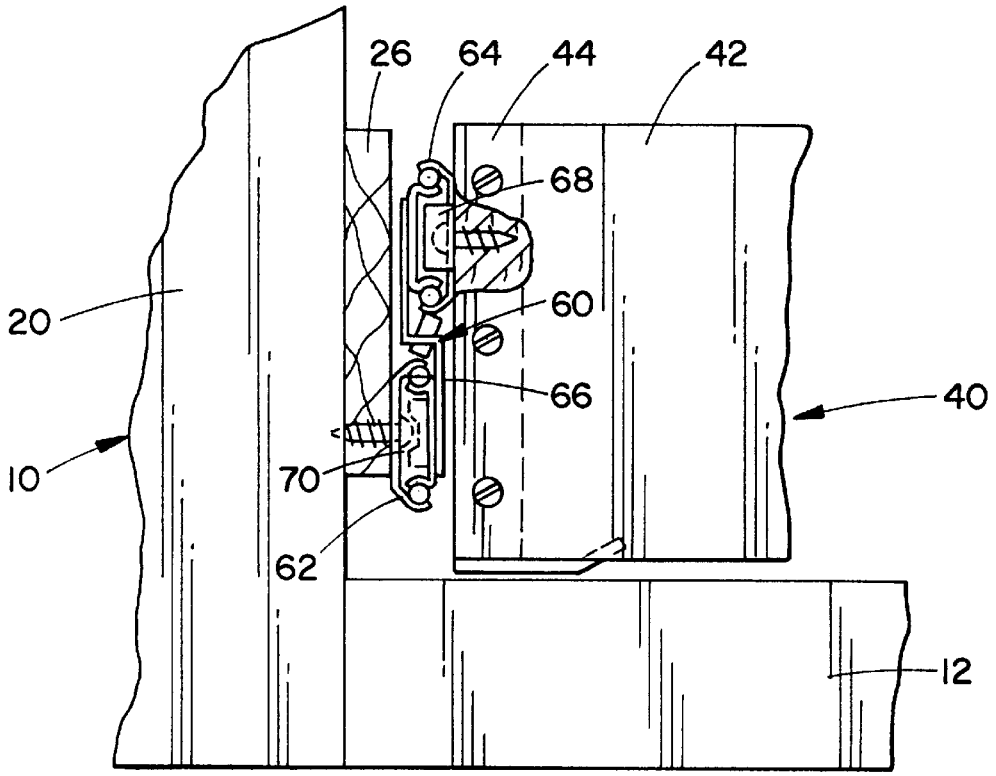
FIG. 6 is an enlarged front elevational view of a portion of the sofa of FIG. 1 with certain parts thereof removed for clarity.

With reference now to FIG. 6, the seat frame 40 is slidably supported on the main frame 10 by a support track 60. The track can comprise a first track member 62 fastened to the horizontal brace 26, which is secured to the right arm section 20 of the main frame 10, and a second track member 64 fastened to the side rail 44 of the seat frame 40. A somewhat S-shaped connecting element 66 joins a pair of slide elements 68 and 70 which are mounted in respective ones of the track members 62 and 64. As best illustrated in FIG. 2, the slide elements of the first and second track members enable the seat frame 40 to slide from a retracted position to an extended position in relation to the main frame 10. The support tracks can be conventional drawer slides of the type manufactured by Knape & Vogt of Grand Rapids, Mich. under model No. 8500P. Of course, a variety of other known slides, which can have single tracks, triple tracks or any other desired number of tracks, could also be used.

Figure 4:
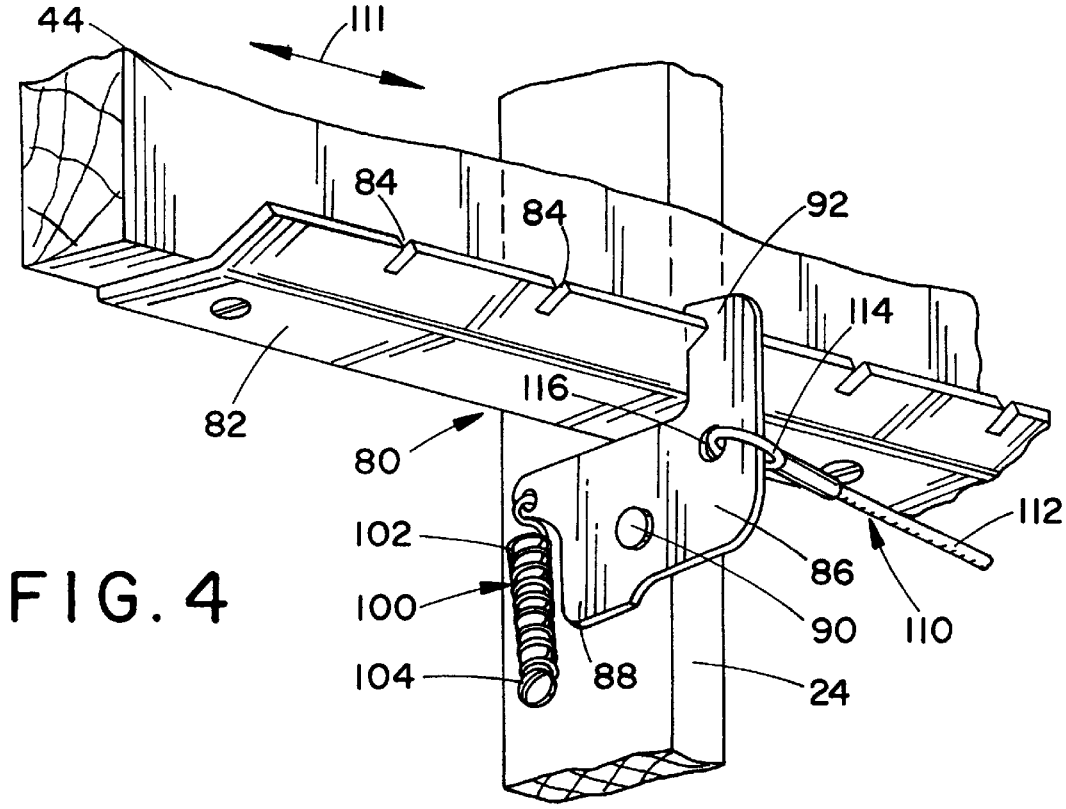
FIG. 4 is a greatly enlarged perspective view of a portion of the sofa of FIG. 1.

With reference now to FIG. 4, a locking means is provided for securing the seat frame 40 in relation to the main frame 10 in a plurality of positions between the retracted position illustrated in FIG. 1 and the extended position illustrated in FIG. 2. The locking means can comprise a plate 82 which is conventionally fastened—by screws or the like—to one of the side rails 44 of the seat frame 40. The plate has a plurality of horizontally spaced slots 84 therein. For example, the slots can be spaced from each other at 1 inch intervals, or at other desired intervals. Cooperating with the plate 82 is an arm 86. The arm has a first section 88 which is secured via a pivot fastener 90 to the vertical brace 24 of one of the right and left arm supports 20, 22. The locking plate 86 also has a second section 92 which is adapted to fit into any of the slots 84.

A biasing means 100 is employed to urge the plate 82 into an end position such that the plate second section 92 extends into one of the slots 84. The biasing means can comprise a spring 102 having a first end secured via a conventional fastener 104 to the vertical brace 24 and a second end secured in an aperture 106 of the plate first section 88. A control means 110 acts on the plate to rotate it around pivot 90 in opposition to the biasing means 100 so as to remove the plate second section 92 from the slots and thereby enable a horizontal movement of the seat frame 40 in relation to the main frame 10 as illustrated by arrow 111. The control means can comprise a cable 112 having a first end 114 secured in an aperture 116 defined in the plate 82. As illustrated in FIG. 5, the cable 112 has a second end 118 which is secured in a suitable aperture in a pivot plate 120. The pivot plate is secured via a fastener 122 to the central rail 18 of the main frame. It is evident from FIG. 5 that a pair of locking means 80 and its attendant biasing means and control means are provided so that each side rail 42 of the seat frame 40 has a respective plate 82 fastened thereto. Similarly, each of the vertical braces 24 has a respective arm 86 pivotally fastened thereto.

A control cable 124 is used to rotate the pivot plate 120. The cable has a first end 126 fastened to the pivot plate 120 and a second end 128 which is secured to a control knob 130 (see FIG. 3). Pulling the knob will pull the control cable 124 thereby pivoting the pivot plate 120 as illustrated by arrow 132. The rotating motion of the pivot plate 120 will cause the respective cables 112 to pull on the respective arms 86 in opposition to the respective biasing means 100 thereby removing the arm second sections 92 from the respective slots 84. This will enable the seat frame 40 to be then slid on the support track 60 in relation to the main frame 10. With the structure of the present invention, such sliding can take place even if a person is seated on the seat frame. Alternatively, a pull strap 134, as illustrated in FIG. 2, can be employed to pull on the control cable 124 and rotate the pivot plate 120.

As mentioned, the slots 84 in the plate 82 could be spaced apart at one inch intervals, one half inch intervals, two inch intervals or the like, if desired. There could be, for example, thirteen such slots on the plate 82. This enables a sequential movement of the seat frame 40 in relation to the main frame 10 by the chosen number of intervals. In sum, the seat can be slid forward in relation to the base of the sofa by a predetermined amount to suit the comfort of the occupant. In a prototype of a couch built according to the present invention, the length of the seat portion can be increased from 24.75 inches to 33.75 inches by the sequential movement of the seat frame forwardly from its retracted position to its extended position. Even in its extended position, the seat frame 40 is fully supported by the main frame 10 due to support track 60 which has elements fastened to each of the main frame and the seat frame.

It should be evident that with this arrangement, the cushions 50 must be deeper than they are on a conventional sofa or chair so as to accommodate the forward sliding motion of the seat frame in relation to the main frame, as best shown in FIG. 3. The cushions 50 in a retracted position of the seat frame, have a rear end extending beneath the upholstered back 54 of the sofa A. In order to insure that no articles fall between the upholstered back 54 and the rear edges of the seat cushions 50 when the seat frame is slid to its forwardmost position—as illustrated in dashed outline in FIG. 3—there is provided an apron 136 having one edge secured to the upholstered back 54 and another edge secured to the seat frame rear rail 46. In the retracted position of the seating unit, the apron 136 is hidden in a cavity 138 defined below the upholstered back 54 of the sofa A and the rear ends of the cushions 50 protrude into the cavity. In conventional couches and sofas, the cavity can have a depth of between five and thirteen inches and this space is unused. The apron 136 also keeps the cushions 50 from being pushed back into the cavity 138.

Figure 7:
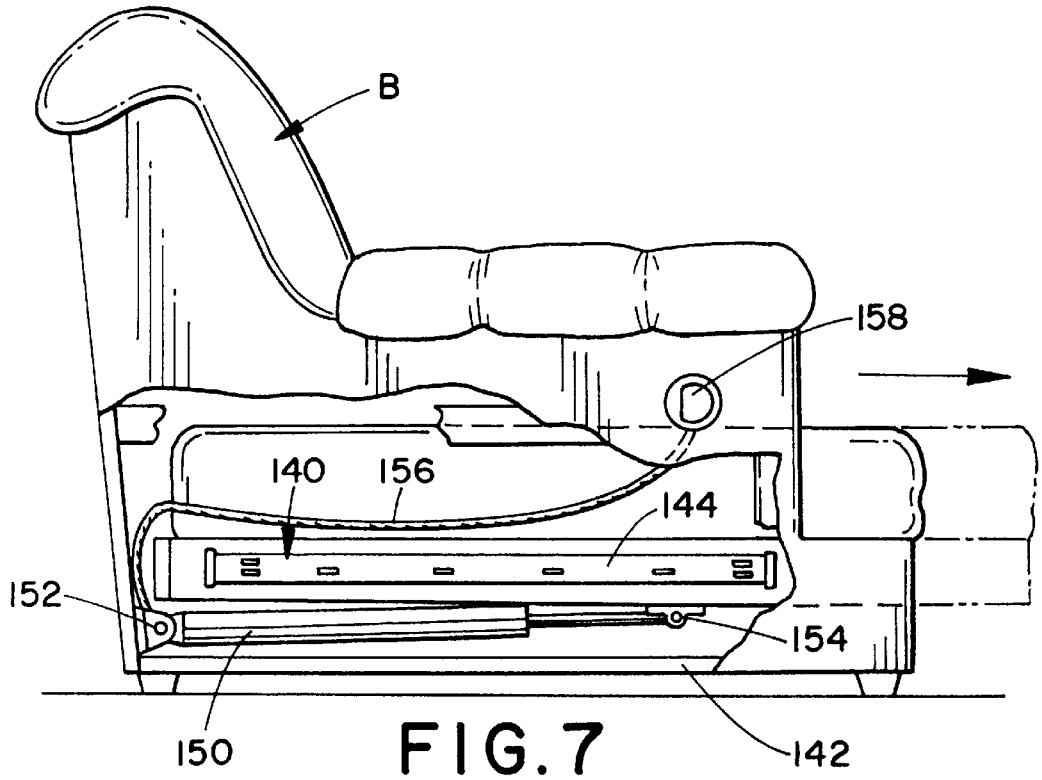
FIG. 7 is a side elevational view, partially broken away, of a chair according to a second preferred embodiment of the present invention.

With reference now to FIG. 7, there is shown a different means for extending a seat frame portion 140 in relation to a main frame portion 142 of a chair B. In this embodiment, while the same type of support track 144 is employed as in the embodiment of FIGS. 1–6, a means is provided for urging the seat frame to move in relation to the main frame. The means comprises a cylinder 150 having a cylinder end 152 pivotally secured to the main frame 142 and having a piston rod end 154 pivotally secured to the seat frame 140. A control cable 156 is actuated by a control knob 158 to actuate the cylinder and allow the piston and rod thereof to move in relation to the cylinder thereby allowing the seat frame 140 to slide in relation to the main frame 142. The chair B can employ the same type of locking mechanism as illustrated above in connection with FIG. 4.

Alternately, the cylinder 150 can be employed as a locking means. If the seat frame 140 is extended from the main frame 142 manually, the cylinder 150 can be used only as a locking means for selectively securing the seat frame in relation to the main frame at one of a plurality of positions. With the cylinder and piston rod arrangement, an infinite number of positions can be provided between a retracted position, as illustrated in solid outline in FIG. 7 and an extended position illustrated in dashed outline.

Figure 8:
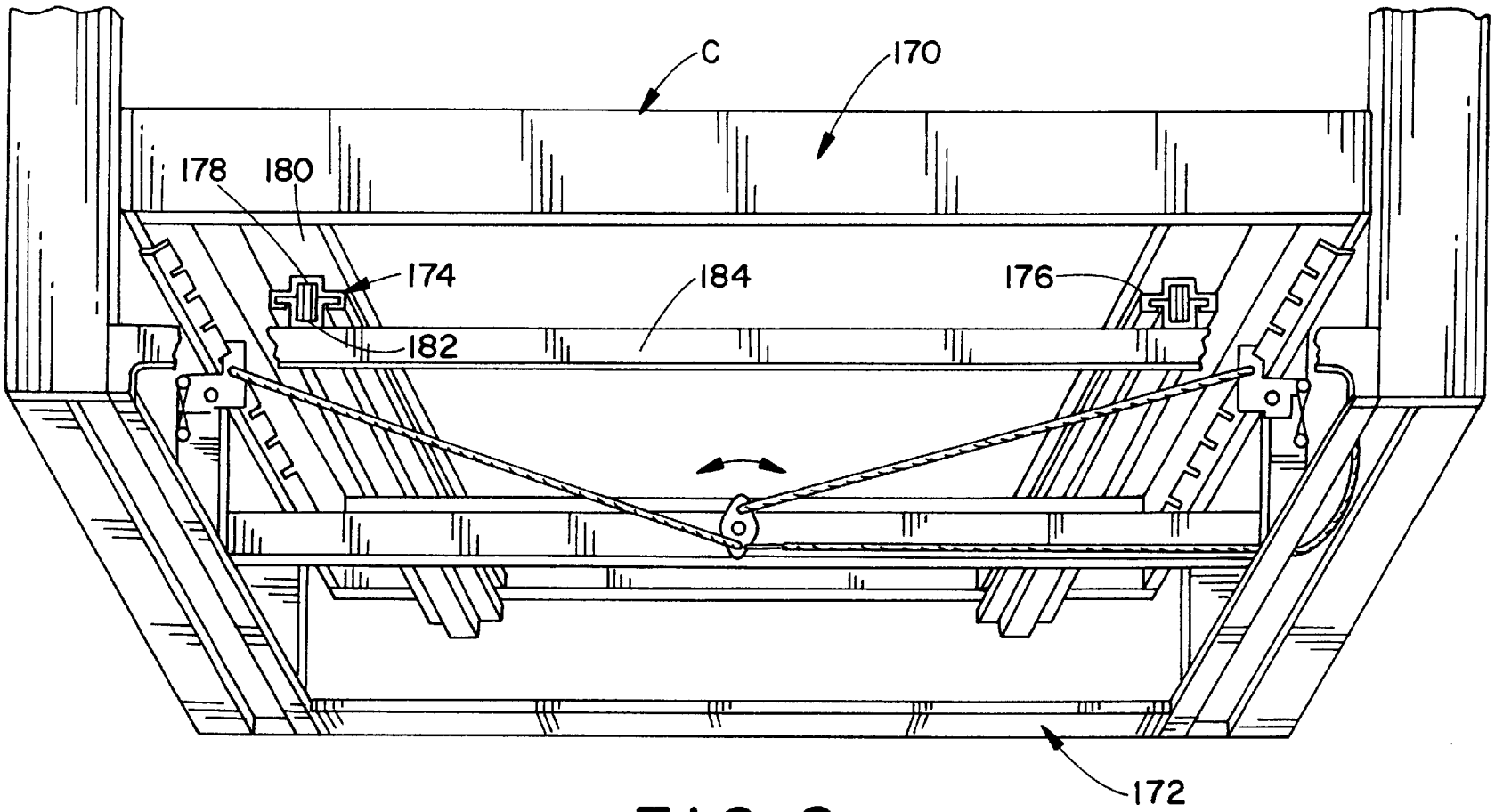
FIG. 8 is a perspective view of a sofa according to a third preferred embodiment of the present invention.

With reference now to FIG. 8, there is shown a sofa C having a seat frame 170 and a main frame 172. In this embodiment, rather than employing the support track illustrated in FIGS. 1–6, there are provided a pair of spaced glide tracks 174 and 176 located beneath the seat frame. The glide tracks are conventional and are identical to each other. Therefore, only one will be discussed in detail herein. The glide track 174 has a first element 178 fastened to a support member 180, which in turn is fastened to the seat frame 170 and extends parallel to the side rails thereof, and a second element 182 which is fastened to a cross brace 184 of the main frame 172. The glide tracks enable a smoother gliding effect on pulling out the seat frame.

Figure 9:
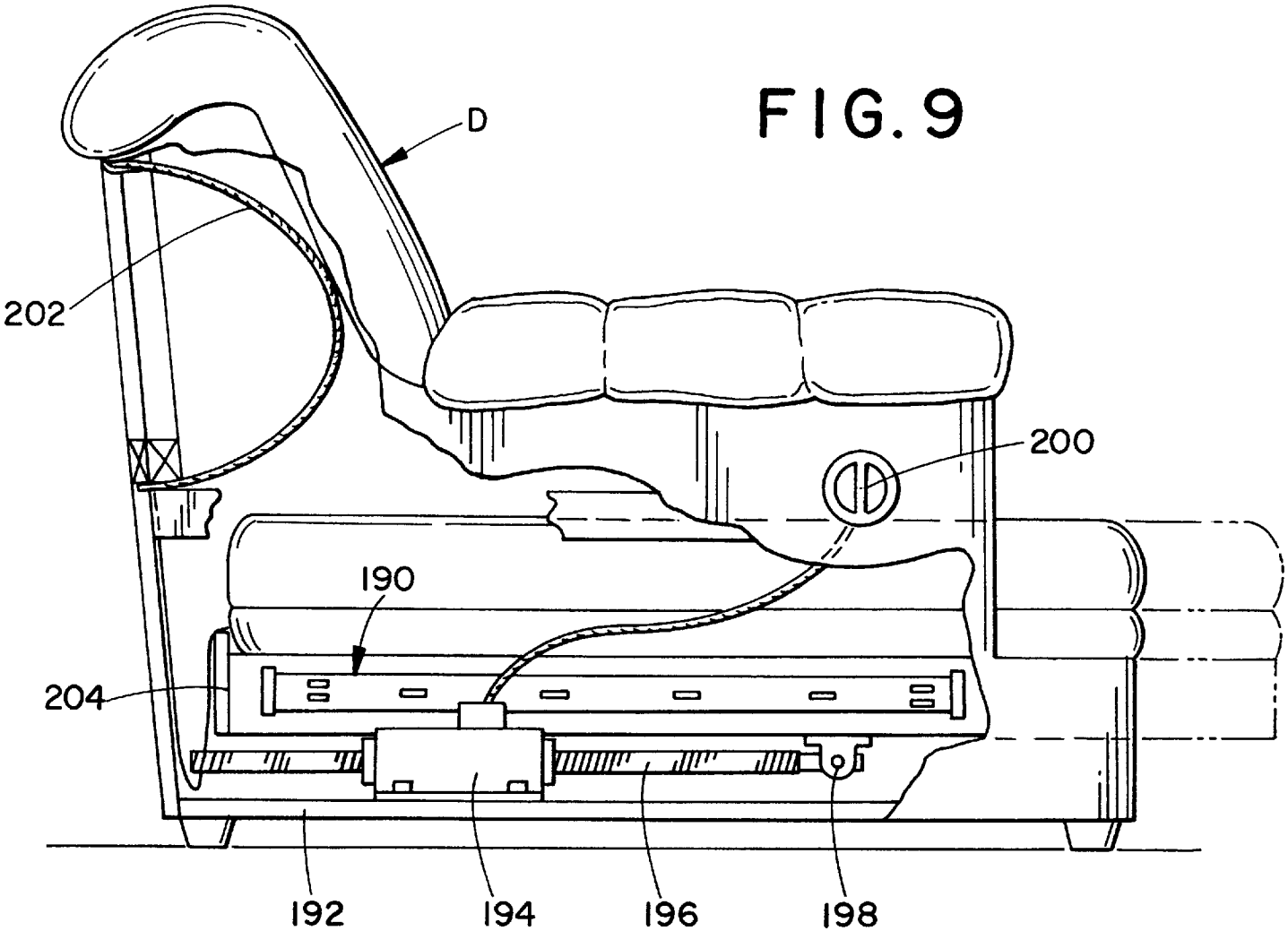
FIG. 9 is a side elevational view of a love seat according to a fourth preferred embodiment of the present invention.

With reference now to FIG. 9, there is shown a love seat D having a seat frame 190 that is slidably mounted on a main frame 192. A means for moving the seat frame 190 in relation to the frame 192 comprises a motor 194 which selectively operates a screw shaft 196 such as a conventional acme screw thread shaft having a first end 198 which is pivotally secured to the seat frame. A conventional handle control 200 enables a rotation of the motor 194 either in a forward direction, so as to extend the seat frame out of the main frame, or rearwardly so as to retract the seat frame back into the main frame. The motor 194 can be located at a desired location along the depth of the love seat. Obviously with this embodiment, electrical power is necessary to the motor 194. While one such motor is illustrated in FIG. 9, it should be appreciated that two motors can be provided, one on each end of the love seat D if so desired.

FIG. 9 further illustrates a flat "S" spring 202 which is suitably secured to the main frame 192. A plurality of such S springs are used to urge the backrest outwardly and provide support for the back of the seat's occupant.

Figures 10A, 10B, 10C:
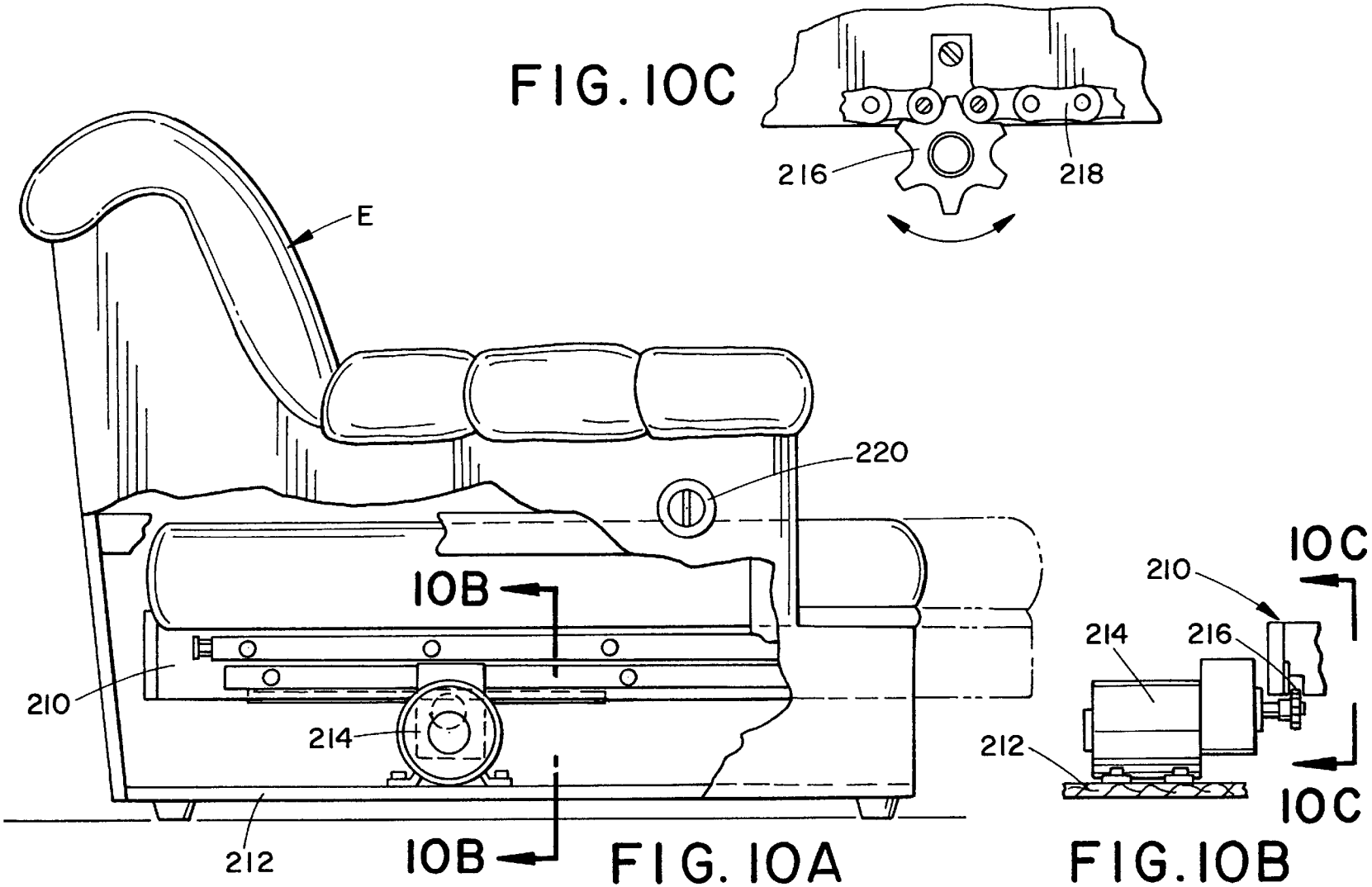
FIG. 10A is a side elevational view, partially broken away, of a sofa according to a fifth preferred embodiment of the present invention.
FIG. 10B is a front elevational view of a portion of the sofa of FIG. 10A.
FIG. 10C is a side elevational view of a portion of the sofa taken along lines 10C—10C.

With reference now to FIG. 10A, another sofa E is there illustrated having a seat frame 210 and a main frame 212. The seat frame is slidably mounted on the main frame via a rail assembly as has been previously described. The seat frame is moved in relation to the main frame via a pair of electric motors 214 (see FIG. 11). Each motor includes a sprocket gear 216 as illustrated in FIG. 10B. The sprocket gear cooperates with a respective rigid chain-like element 218 which is fastened to the seat frame 210 as shown in FIG. 10C. For control purposes, a control knob 220 is mounted on one of the arms of the sofa E. In this embodiment as with the embodiment of FIG. 9, electrical power is necessary to operate the motors.

Figure 11:
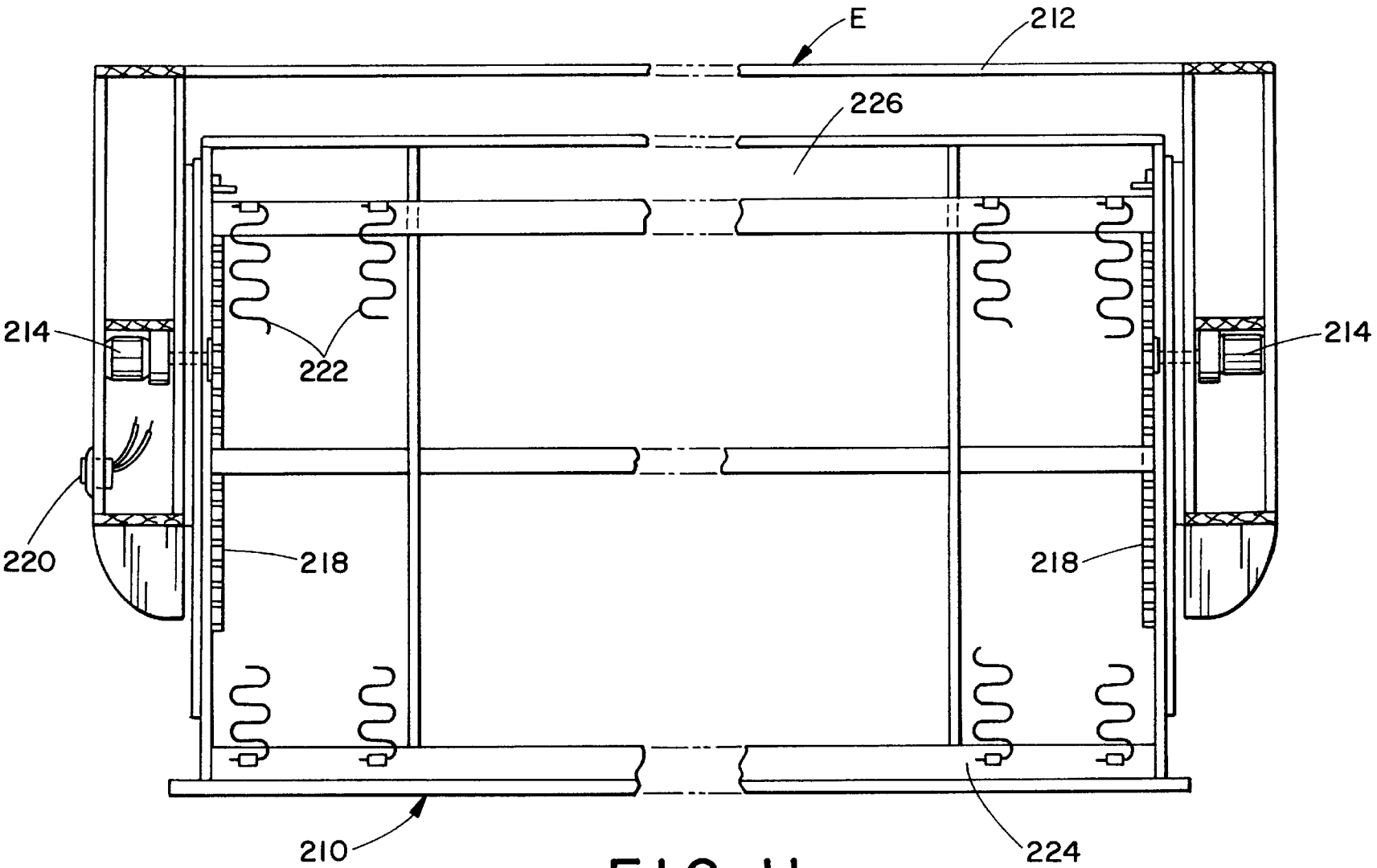
FIG. 11 is a bottom plan view of the sofa of FIG. 10A, partially broken away.

As illustrated in FIG. 11, supporting the cushions on the seat frame 210 are a plurality of spaced flat S springs 222. Each of these is secured to a front support member 224 and a rear support member 226 fastened to the seat frame 210. The support members are preferably boards that are secured by conventional means to the other elements of the seat frame 210. Such springs and boards can be used to support the cushions in the other embodiments illustrated previously.

Figure 12A:
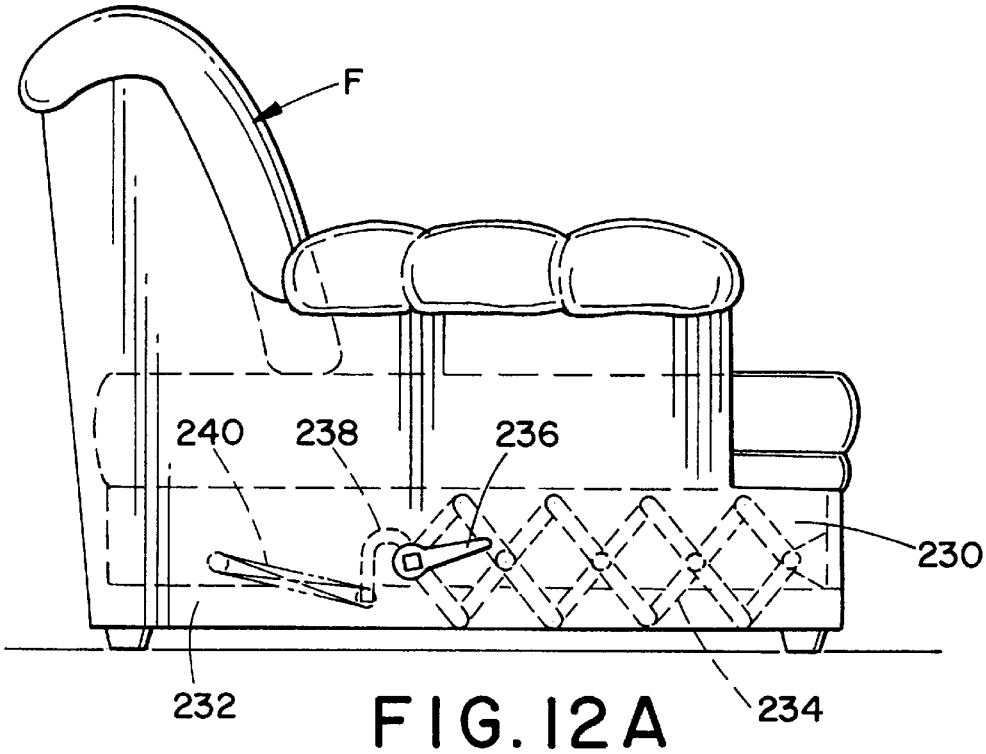
FIG. 12A is a side elevational view of a chair or sofa according to a sixth preferred embodiment of the present invention in a retracted position.
Figure 12B:
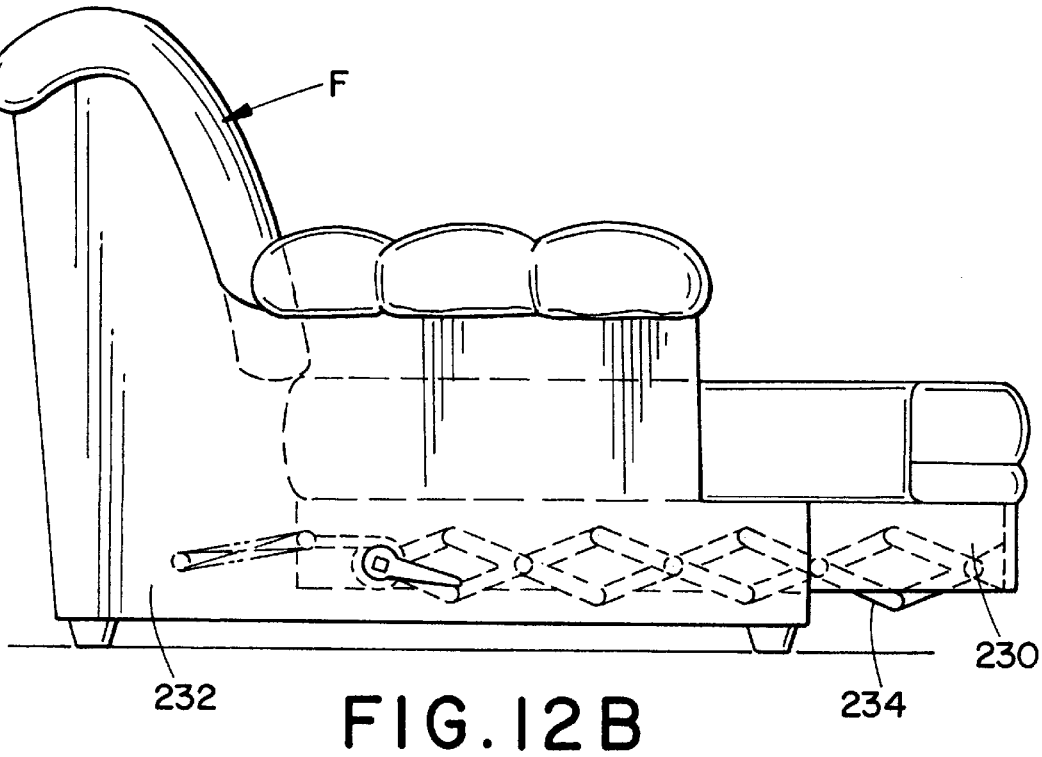
FIG. 12B is a side elevational view of the chair of FIG. 12A in an extended position.

With reference now to FIG. 12A, a chair F includes a seat frame 230 which is slidably mounted in relation to a main frame 232. A control means for actuating the seat frame in relation to the main frame comprises a scissor mechanism 234 which is actuated by a handle 236. The handle is connected to an A-hook 238 which is biased by a spring 240. This mechanism is conventional and enables a movement of the seat frame 230 from the retracted position illustrated in FIG. 12A to the extended position illustrated in FIG. 12B.

Figure 13:
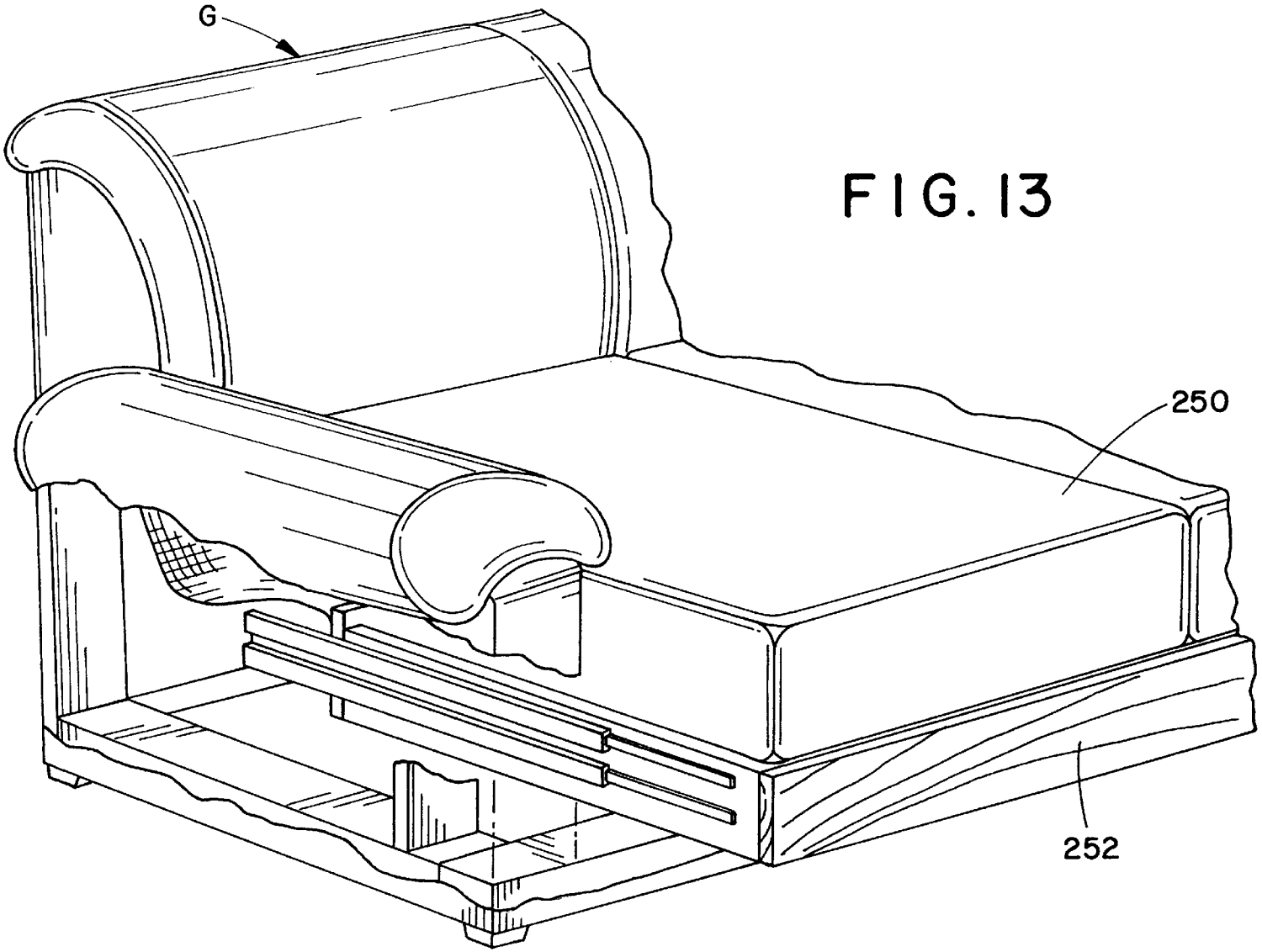
FIG. 13 is a perspective view, partially broken away, of a couch according to a seventh preferred embodiment of the present invention.

FIG. 13 illustrates a couch in which a plurality of cushions 250 are supported on a seat frame 252. Unlike the embodiment illustrated in FIGS. 1 and 2, the cushions 250 are all substantially rectangular and do not have the sidewardly extending protrusions illustrated in FIGS. 1 and 2. Therefore, the seat frame 252 similarly does not have a sidewardly extending section on each end.

Figure 14:
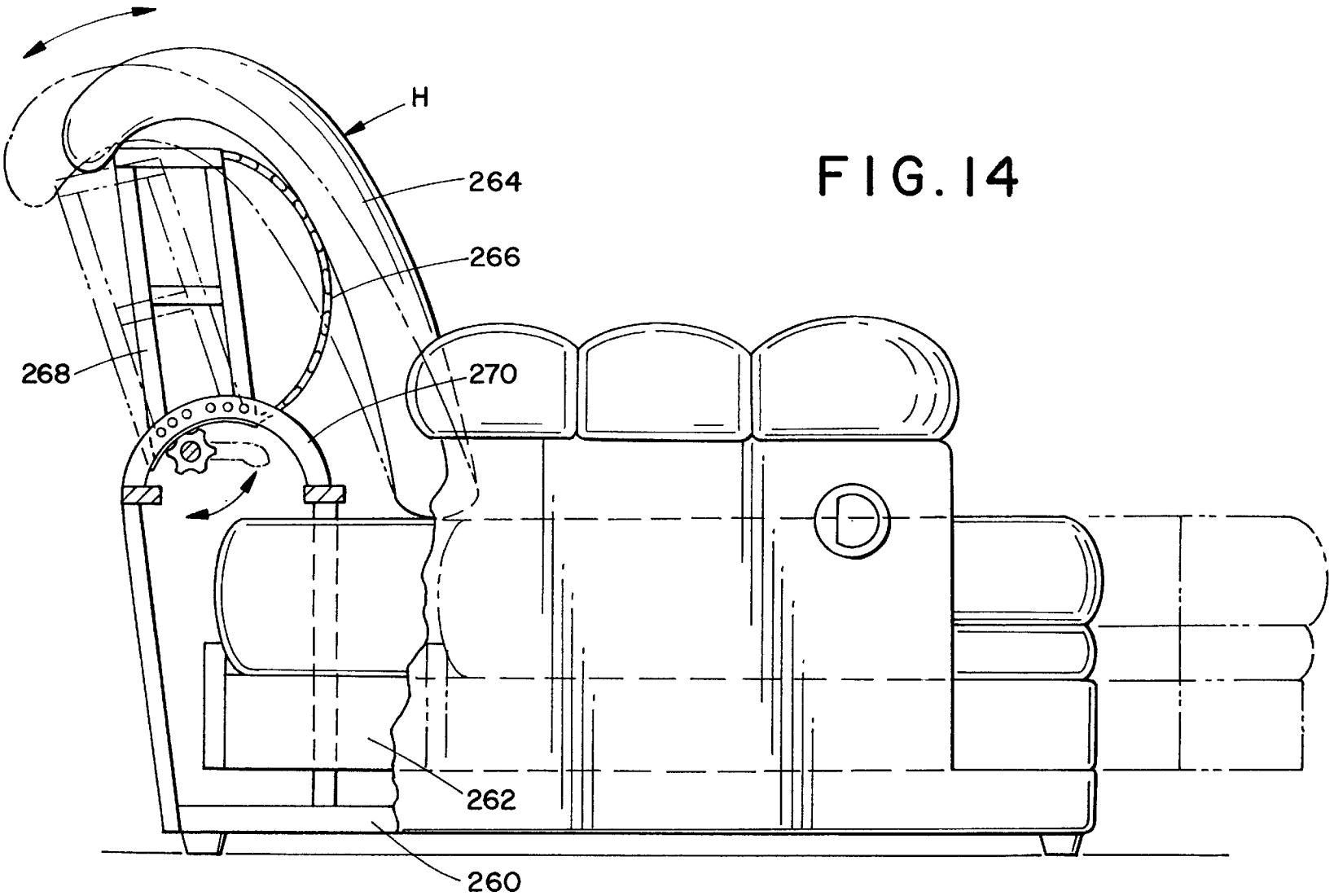
FIG. 14 is a side elevational view, partially in cross-section, of a couch according to an eighth preferred embodiment of the present invention.
Figure 15:
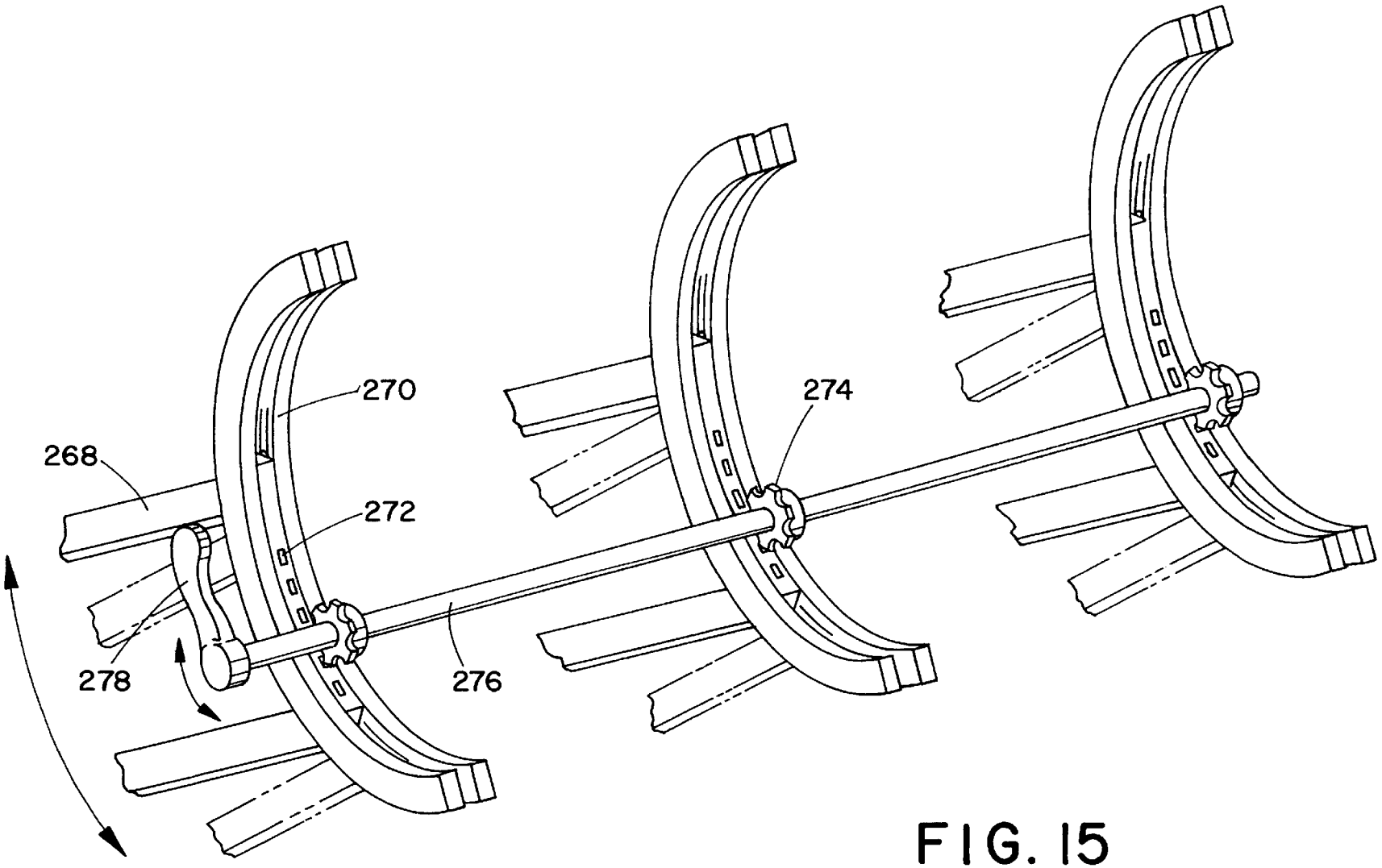
FIG. 15 is a bottom plan view of a backrest reclining mechanism for the couch of FIG. 14.

While all of the foregoing embodiments illustrated a design in which a backrest portion of the couch or seat was fixed, FIG. 14 illustrates an embodiment in which both the backrest and the seat portion of a couch H can move. The couch H comprises a main frame 260 on which a seat frame 262 is slidably supported. The main frame includes a backrest section 264. A set of flat S springs 266 resiliently supports the backrest 264. The springs 266 are mounted on a set of support braces 268. The support braces are, in turn, each fastened to a track 270. As is evident from FIG. 15, a plurality of such tracks are provided with each track being substantially U-shaped. Each track includes a central area having a number of longitudinally spaced slots 272 which are meant to accommodate gear teeth of respective sprockets 274. The sprockets are mounted on a rod 276. One end of the rod has fastened thereon a handle 278 which protrudes out of the backrest portion 264 of the couch so as to be manually engageable. With this embodiment, not only can the seat frame 262 be moved, as illustrated in dashed outline in FIG. 14, but the upper end of the backrest can also be lowered somewhat as similarly illustrated in dashed outline in FIG. 14. Therefore, this embodiment illustrates a movable back support section for a couch which also has a movable seat section.

Figure 16:
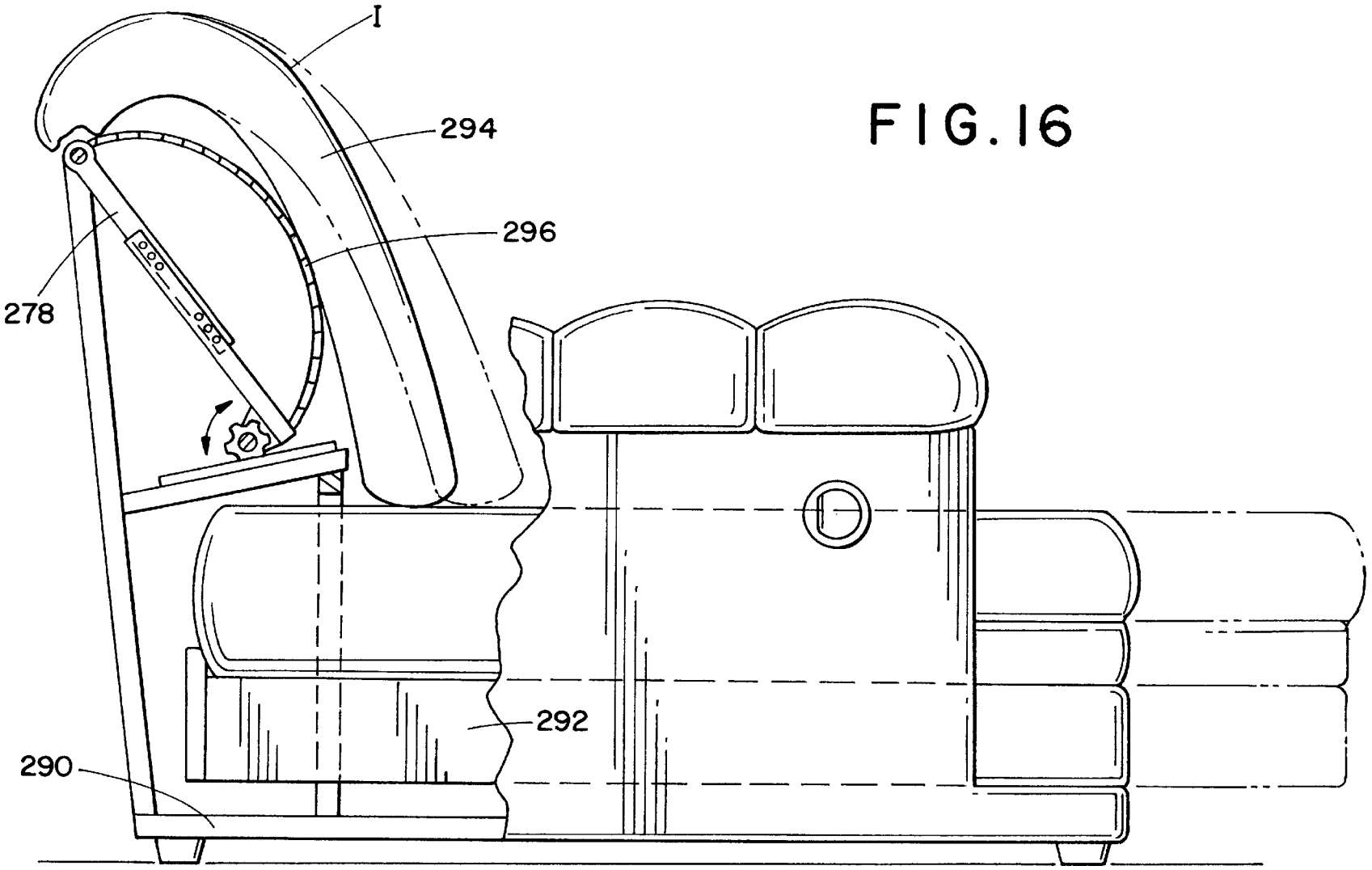
FIG. 16 is a side elevational view, partially broken away, of a couch according to a ninth preferred embodiment of the present invention.
Figure 17:
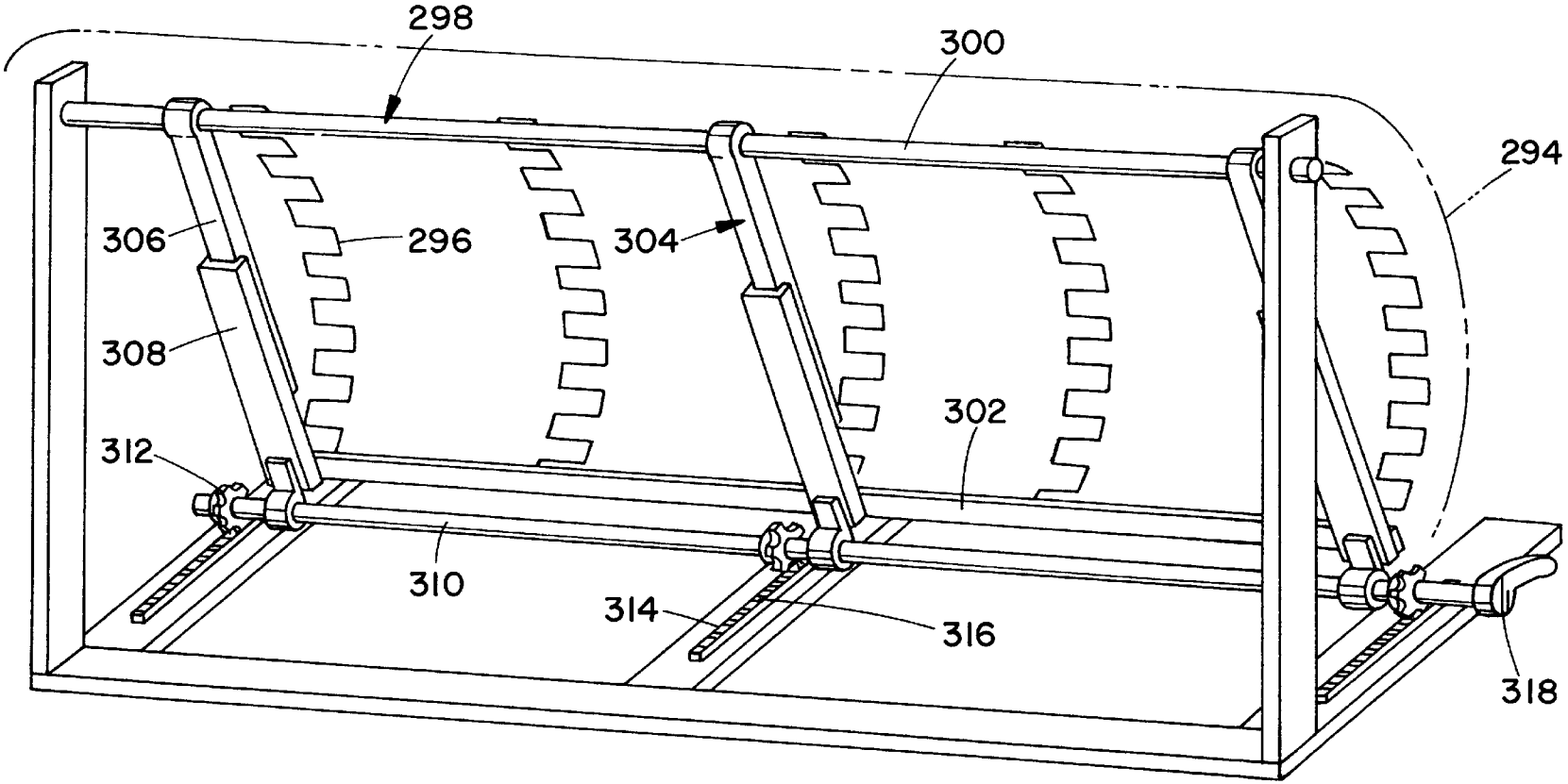
FIG. 17 is a perspective view from the rear of a lumbar backrest reclining mechanism for the couch of FIG. 16.

With reference now to FIG. 16, a couch I is there illustrated which has a movable seat and a movable backrest. In this embodiment, a main frame 290 has slidably mounted thereon a seat frame 292. The main frame comprises a backrest section 294 which is resiliently biased by a plurality of spaced flat S springs 296, as can be best seen from FIG. 17. The S springs are mounted on a support frame 298. The support frame comprises an upper rod 300 for holding a first end of each spring 296 and a support bar 302 for holding a second end of each spring. The rod 300 and support bar 302 are joined together by a plurality of spaced brace members 304. These each comprise a first telescopic element 306 and a second telescopic element 308. The set of second elements 308 are secured to a rod 310. Mounted on the rod are a plurality of sprockets 312. The sprockets each travel on a respective track 314 which includes a plurality of longitudinally spaced openings 316 for accommodating the teeth of the sprockets. The rod 310 is actuated by a handle 318 which is mounted on one end thereof so as to extend away from the backrest. With this embodiment of the invention, the bottom end of the backrest support can move inwardly and outwardly as is illustrated in dashed outline in FIG. 16.

Figure 18:
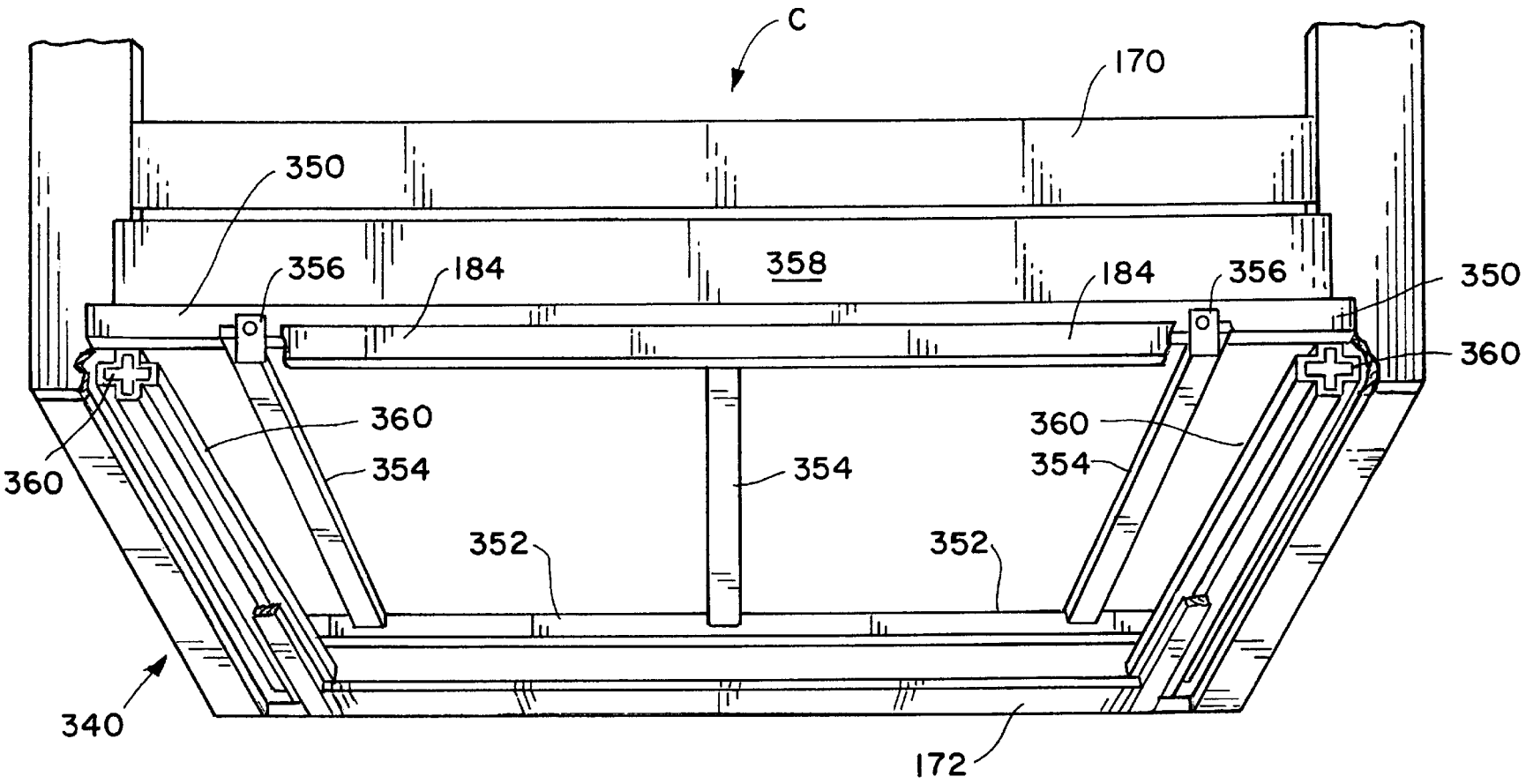
FIG. 18 is a perspective view of the third preferred embodiment sofa utilizing a first alternate frame assembly according to the present invention.

The present invention further provides an alternate frame assembly for use with any of the seating units described herein. For purposes of discussion, this first alternate frame assembly 340 will be described in conjunction with sofas A, C, and E. FIG. 18 illustrates the underside of the third preferred embodiment sofa C utilizing the first alternate frame assembly 340. The frame assembly 340 comprises a longitudinal rear frame member 350, a longitudinal front frame member 352, and one or more transverse frame members 354, preferably extending between the frame members 350 and 352. The longitudinal rear frame member 350 is disposed along the rear portion of the seating unit, preferably parallel to a cross brace 184. Similarly, the front frame member 352 is disposed along the front region of the seating unit, and most preferably oriented parallel to the rear frame member 350. The one or more transverse frame members 354 extend between the frame members 350 and 352 and are preferably oriented perpendicular thereto. One or more brackets 356 can be used to secure the frame members 350, 352, and/or 354 to one another. The frame members 350, 352, and 354 form a rigid assembly that may be extended from the front of the seating unit, preferably by sliding along one or more tracks.

Extension of the frame assembly 340 is facilitated by a pair of sliding track assemblies 360 affixed to the seat frame 170 and/or main frame 172. The track assemblies 360 are preferably oriented perpendicular to the longitudinal frame members 350 and 352. The track assemblies may be horizontally oriented, or oriented at an acute angle relative to a horizontal floor surface. As will be appreciated, the track assemblies may be inclined relative to the floor by several degrees to provide a comfortable seating surface regardless of whether the seat frame 170 is retracted or extended relative to the main frame 172. Each track assembly 360 preferably comprises a first section that is secured to a stationary portion of the seating unit such as the main frame 172. Each track assembly also preferably comprises a second section that is secured to a movable portion of the seating unit such as the seat frame 170. The first and second sections are preferably slidably engaged with each other so that the second section may be easily moved relative to the first section, yet maintained or held in alignment therewith. A wide array of friction-reducing components such as bearings and lubricants may be used in the track assemblies 360 as known in the art.

Figure 19:
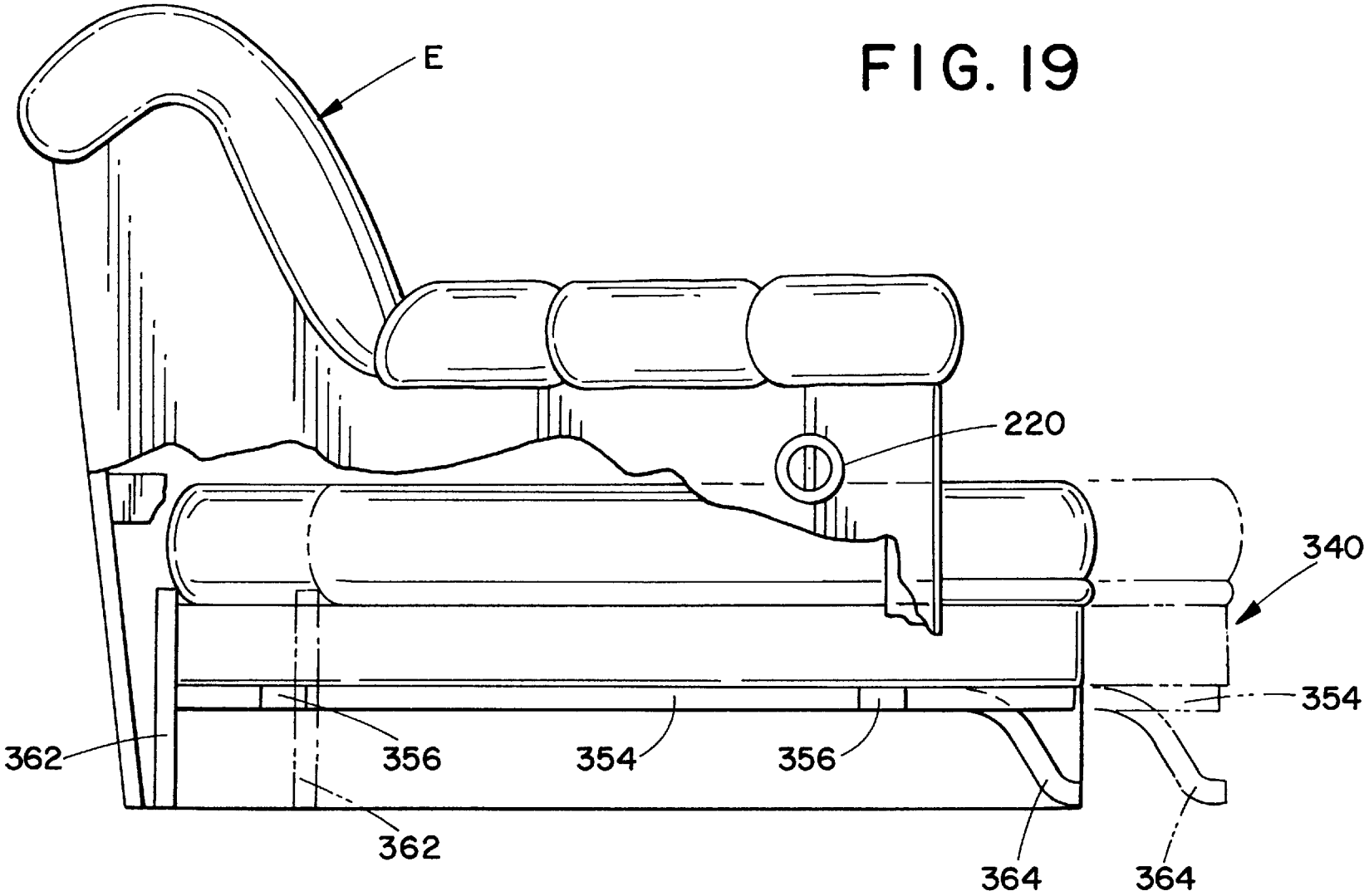
FIG. 19 is a side elevational view, partially broken away, of the fifth preferred embodiment sofa utilizing the first alternate frame assembly according to the present invention.

As previously noted, the frame assembly 340 may be used in any of the seating units described herein. FIG. 19 illustrates the fifth preferred embodiment sofa E utilizing the first alternate frame assembly 340. It is most preferred to provide one or more rear interior legs and one or more front interior legs for the frame assembly 340 to provide additional support for the frame assembly 340. FIG. 19 illustrates a rear interior leg 362 and a front interior leg 364, both extending downwardly from the underside of the frame assembly 340. As shown in FIG. 19, when the seat and accompanying frame assembly 340 is extended from the front of the seating unit to an extended position shown as dashed lines in FIG. 19, the front and rear interior legs 364 and 362, respectively, are also moved forward. It is contemplated to provide a wheel or roller assembly (not illustrated) at the distal end of each interior leg to facilitate movement of the interior legs with the seat as the seat is extended or retracted. This feature significantly increases the stability and support capacity of the seating unit, particularly when in an extended configuration.

As previously noted, it may in some instances be desirable to orient the movable seat at a slight inclination for comfort purposes. Regardless of the seat configuration, the track assemblies are preferably horizontally oriented, particularly when used in conjunction with the front and rear interior legs 364 and 362. As will be appreciated, the movable seat is preferably configured such that it extends outward in a plane parallel to the floor surface. And so, in this preferred configuration, the distance between the underside of the seat or interior legs, and the floor is the same regardless of whether the seat is extended, retracted, or at some position therebetween.

Figure 20:
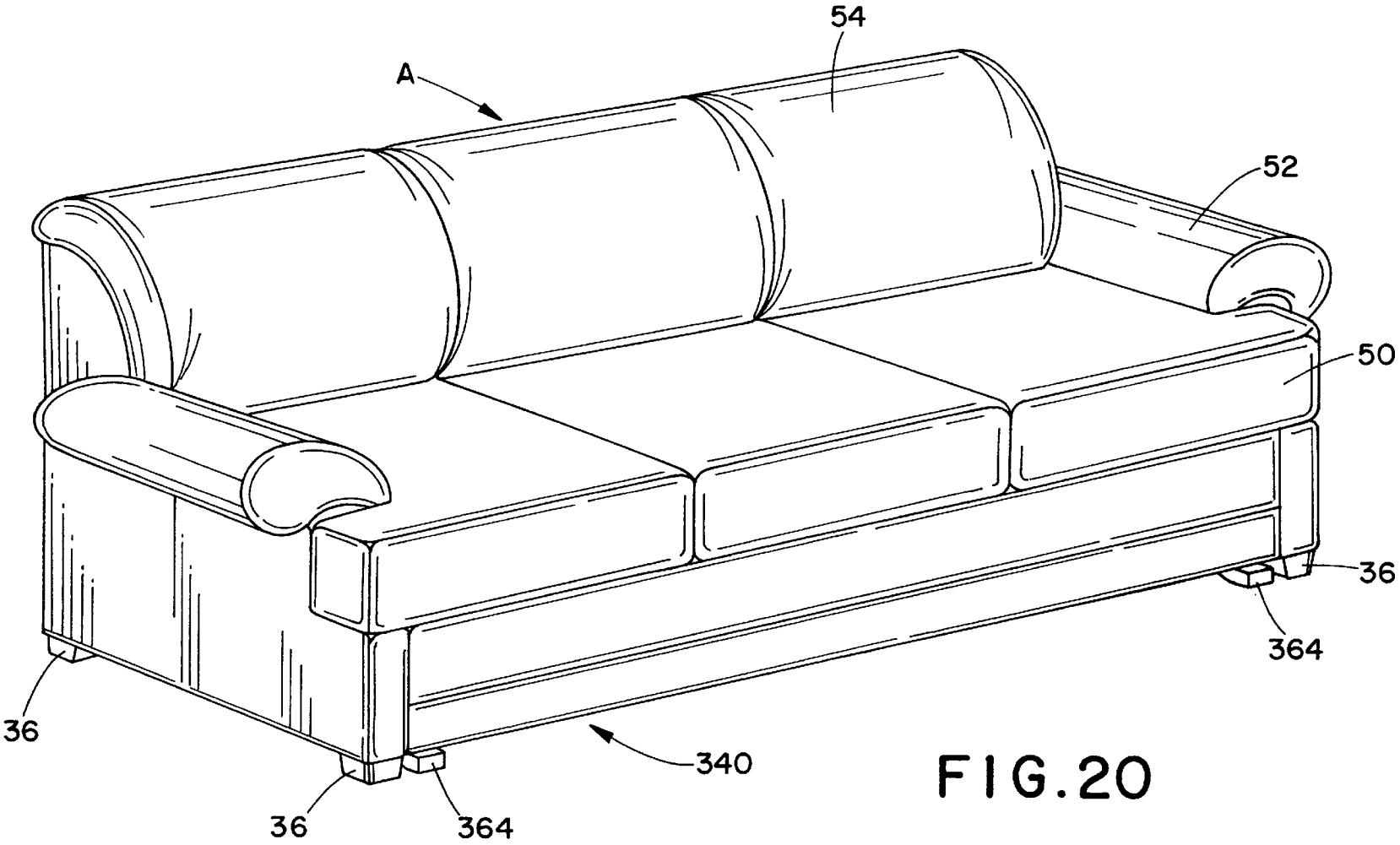
FIG. 20 is a perspective view of the first preferred embodiment sofa utilizing the first alternate frame assembly according to the present invention.

FIG. 20 illustrates the first preferred embodiment sofa A utilizing the alternate frame assembly 340. This view illustrates the relative position of the interior legs, such as front interior legs 364, relative to the support feet 36 of the sofa A.

Figure 21:
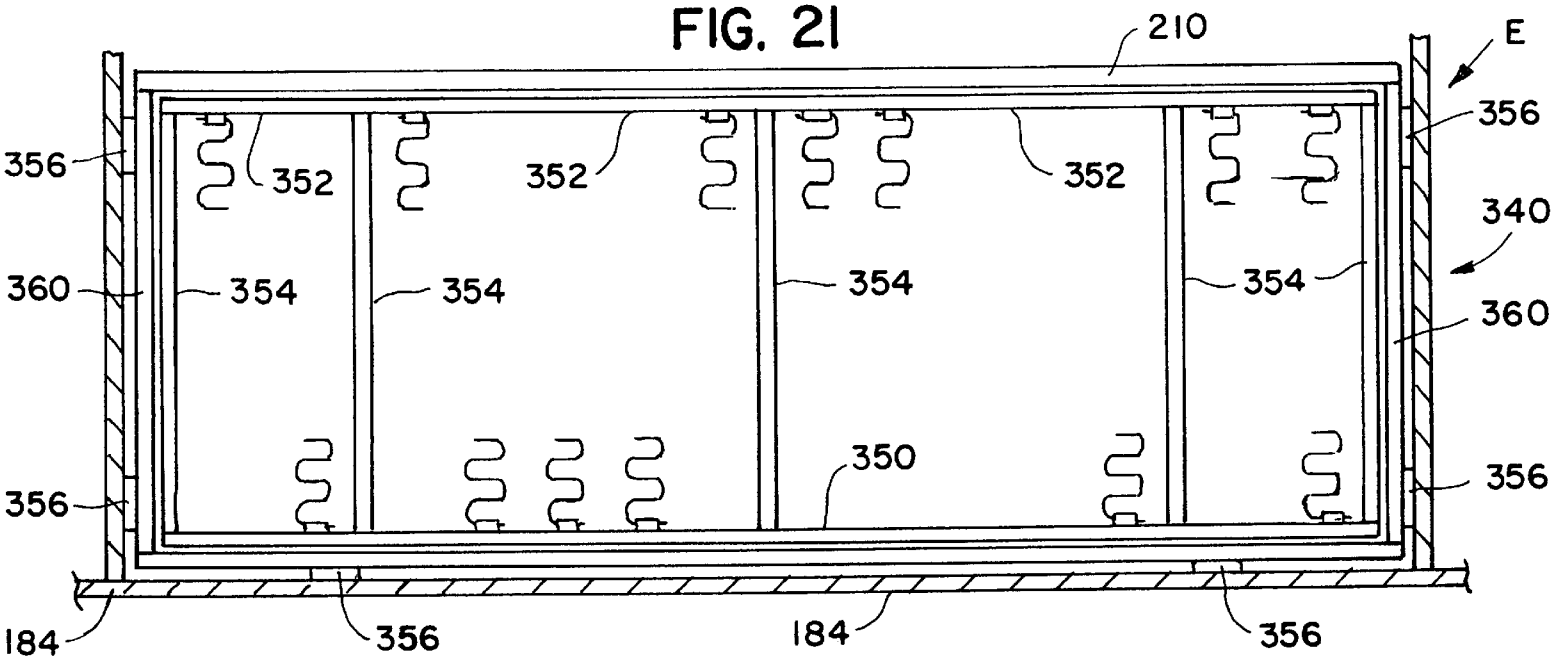
FIG. 21 is a bottom plan view of the fifth preferred embodiment sofa utilizing the first alternate frame assembly according to the present invention.
Figure 22:
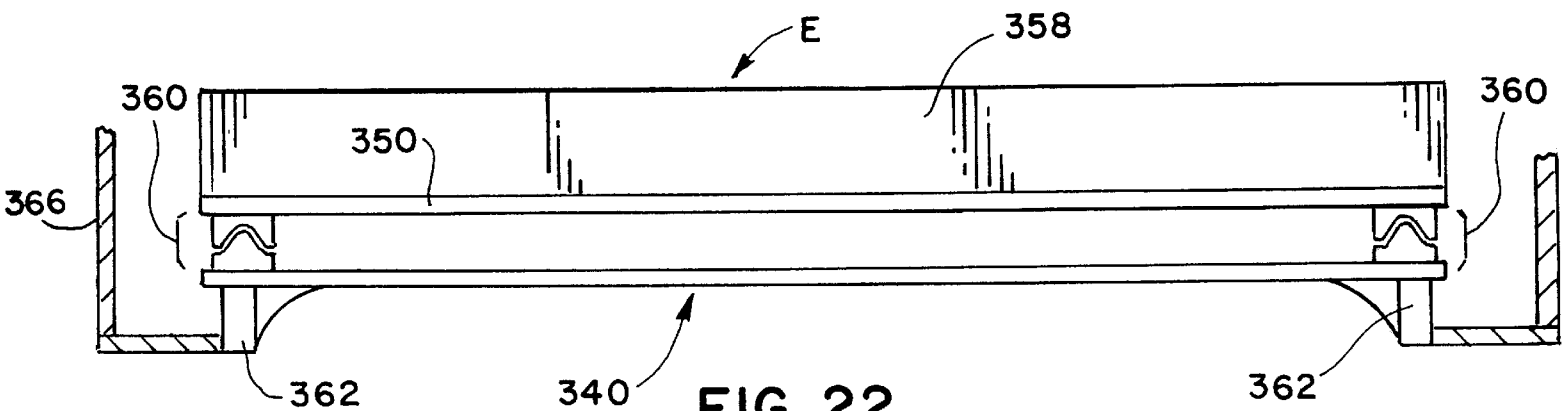
FIG. 22 is a partial rear elevational view of the fifth preferred embodiment sofa utilizing the first alternate frame assembly according to the present invention.

FIGS. 21 and 22 further illustrate the alternate frame assembly 340. FIG. 21 is a bottom plan view of the fifth preferred embodiment sofa E utilizing the frame assembly 340. In this version, a plurality of transverse frame members 354 are utilized, including positioning such members at both distal ends of the sofa E. FIG. 22 illustrates the rear of the fifth preferred embodiment sofa E and the frame assembly 340. FIG. 22 illustrates a riser member 358 preferably disposed on the top surface of the longitudinal rear frame member 350 and extending to, or constituting, part of a movable seat section. The riser member 358, is also shown in FIG. 18. It is also contemplated to use a similar riser member disposed along the top of the longitudinal front frame member 352. A pair of sliding track assemblies 360 are shown schematically. As shown in FIG. 22, it is also desirable to dispose the interior legs, such as the rear interior legs 362, directly below the sliding track assemblies 360, to provide support for the seating portion, particularly when the seat portion is an extended position. The interior legs, such as the rear interior legs 362 may also be configured such that when the seat portion is retracted within the seating unit, the legs 362 are proximate to, or immediately adjacent to, a side arm frame 366.

Figure 23:
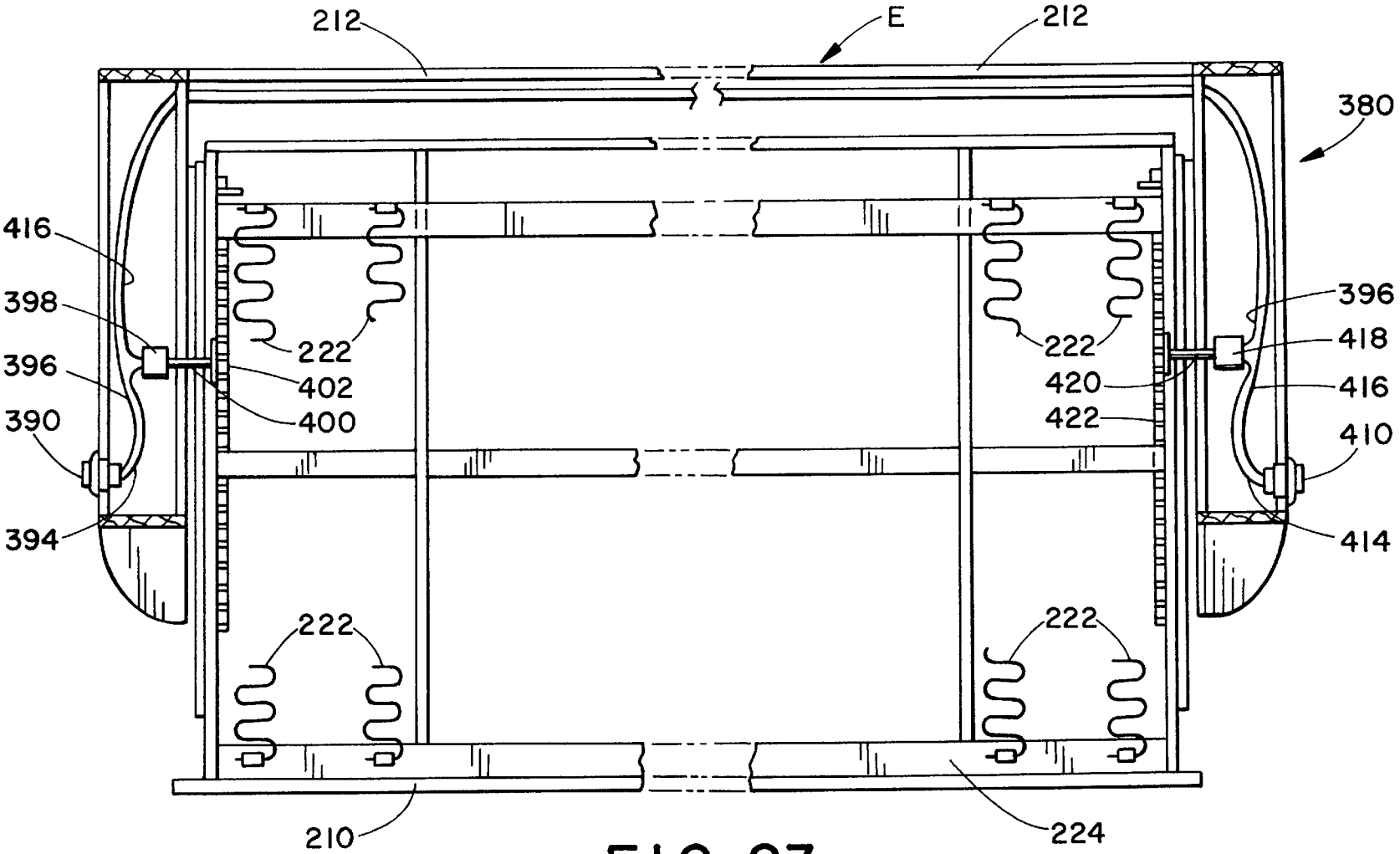
FIG. 23 is a bottom plan view of the fifth preferred embodiment sofa utilizing a first alternate actuation mechanism according to the present invention.

The present invention also provides numerous actuation mechanisms for enabling or effecting extension of the seat portion from the main seating unit. In addition to the various embodiments previously described herein, FIG. 23 illustrates an alternate actuation mechanism 380 utilized in the preferred embodiment sofa E. This alternate actuation mechanism 380 comprises one or more actuators or control knobs, one or more dual cable control adapters, one or more latching assemblies, and associated cabling. Specifically, and referring to FIG. 23, the alternate actuation mechanism 380 comprises a first control knob 390 disposed on one side or end of the sofa E. That control knob 390, upon proper or appropriate actuation, may activate or disengage, one or more latching assemblies, such as latching assemblies 400 and 420 described in greater detail herein, to enable the seat portion to be extended from or retracted within the seating unit. In the configuration shown in FIG. 23, a first side direct cable 394 extends between the first control knob 390 and a first side dual cable control adapter 398. A first side remote cable 396 extends between the first control knob 390 and a second side dual cable control adapter 418. All cabling utilized in conjunction with the actuation mechanism 380 preferably comprises an outer sheath or flexible housing, and an inner cable member, slidable therein. A first side latching assembly 400 is in operable engagement with the first side dual cable control adapter 398, preferably by a first side latch cable 404 (more fully described in conjunction with FIGS. 24–26). Disposed at the other end or side of the sofa E is a second control knob 410. A second side direct cable 414 extends between the second control knob 410 and the second side dual cable control adapter 418. A second side remote cable 416 extends between the second control knob 410 and the first side dual cable control adapter 398. A second latching assembly 420 is provided proximate the second side dual cable control adapter 418. The second latching assembly 420 is preferably in operable engagement with the second side dual cable control adapter 418 via a second side latch cable 424 (also described and shown in greater detail below). Upon actuation at either control knob 390 or 410, the seat portion may be extended from or retracted within the seating unit by disengagement of both latching assemblies 400 and 420. Each latching assembly is operably engageable with a latch rail 402 or 422, preferably affixed to the movable seat.

Figure 24:
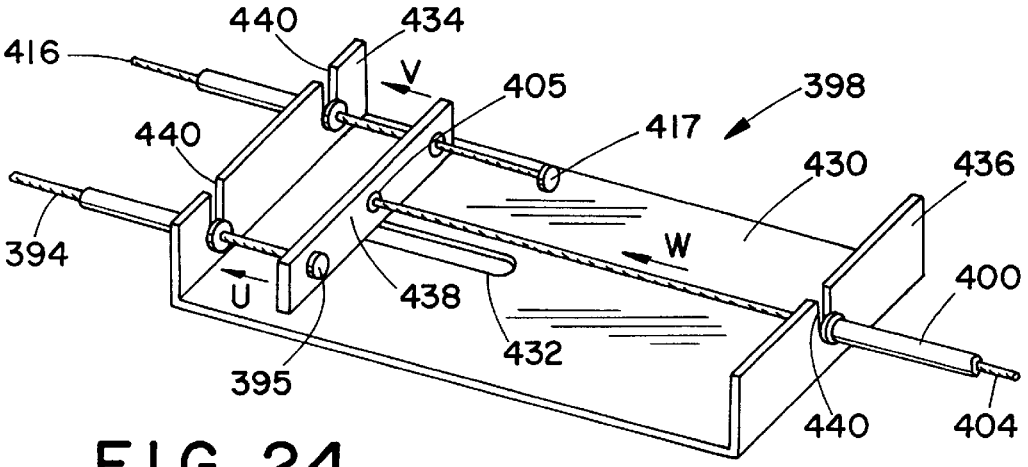
FIG. 24 is a perspective view of a preferred dual cable control adapter utilized in the first alternate actuation mechanism according to the present invention, and illustrating the adapter during actuation from one side or end of a seating unit.
Figure 25:
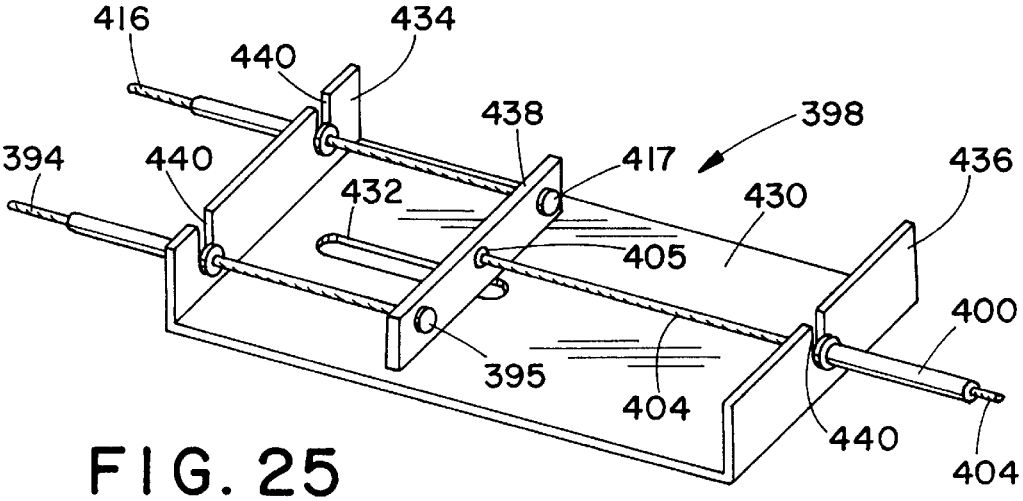
FIG. 25 illustrates the adapter shown in FIG. 24 in a stationary configuration.
Figure 26:
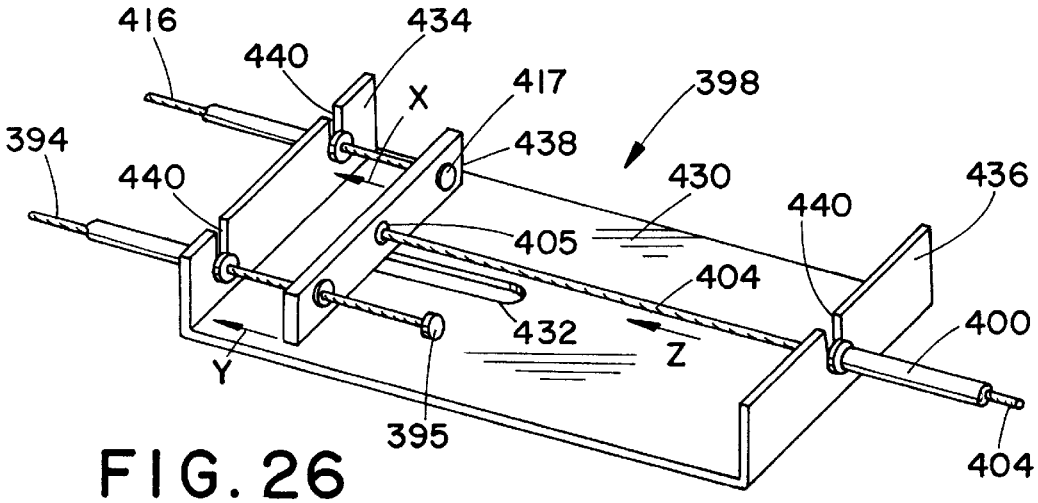
FIG. 26 illustrates the adapter shown in FIG. 24 during actuation from a second or other side or end of a seating unit.

FIGS. 24, 25, and 26 illustrate in greater detail the preferred dual cable control adapter utilized in the first alternate actuation mechanism 380. It is to be understood that the following description of the preferred embodiment adapter is given with respect to the first side dual cable control adapter 398, and so all references are with regard to that adapter and its associated cables and latching assembly at the first end of the sofa E. FIG. 25 illustrates the adapter 398 in a stationary configuration, i.e. in which neither control knob 390 or 410 has been actuated to change the position of the seat. The control adapter 398 comprises an adapter housing 430 having a first end 434 and a second, opposite end 436. Preferably, the first and second ends 434 and 436 are angled upwardly as shown in the referenced drawings. The adapter 398 further comprises a slidable actuator member 438, generally movable along a longitudinally oriented track 432 defined in, or provided along, the housing 430. The first end 434 preferably provides a pair of cable engagement slots 440 for receiving a pair of cables such as the first side direct cable 394 and the second side remote cable 416. The slots 440 are preferably sized so that they releasably engage an outer sheathing member or conduit enclosing the movable cable portion. The second end 436 similarly provides a cable engagement slot 440 for receiving a latch cable such as the first side latch cable 404. Each of the three cables 394, 416, and 404 extend toward and operably engage the actuator member 438. At each cable end is a retention member, preferably in the form of a ball or bulbous portion affixed to the cable end. The end 395 of the cable 394 extends through an aperture defined in the actuator member 438. Similarly, the end 417 of the cable 416 extends through a second aperture defined in the member 438. The enlarged end of each cable prevents the cable from being pulled through the respective aperture and away from the member 438. The latch cable 404 also extends to the member 438 and preferably, through an aperture defined in the member 438. Operation of the control adapter is as follows.

Referring to FIG. 24, in the event that the control knob 390 is actuated to thereby pull or place tension upon cable 394, the distal end 395 of the cable is pulled toward the first end 434 and engages the movable member 438. Movement of the cable 394 in the direction of arrow U causes movement of the member 438 along the track 432 in the direction of arrow V. Since the pulling force is applied through the cable 394 and not the other cable 416, the distal end 417 of the cable 416 remains stationary, or substantially so, as shown in FIG. 24. This configuration minimizes inducing excessive slack in the cable not being tensioned. However, it is contemplated to securely affix the end 417 of the cable 416 to the member 438 so that the cable end 417 is displaced along with the member 438 at all times. Movement of the member 438 in the direction of arrow V pulls the latch cable 404 in the direction of arrow W. Movement of the latch cable 404 actuates the latching assembly 400 as described in greater detail below.

Referring to FIG. 26, actuation by the other control knob, i.e. control knob 410 is shown. Upon actuation by the control knob 410, the cable 416 is pulled in the direction of arrow X. This causes displacement of the member 438 in the direction of arrow Y along the track 432. Linear movement of the member 438 pulls the cable 404 in the direction of arrow Z as shown in FIG. 26, thereby actuating the latching assembly 400.

Figure 27:
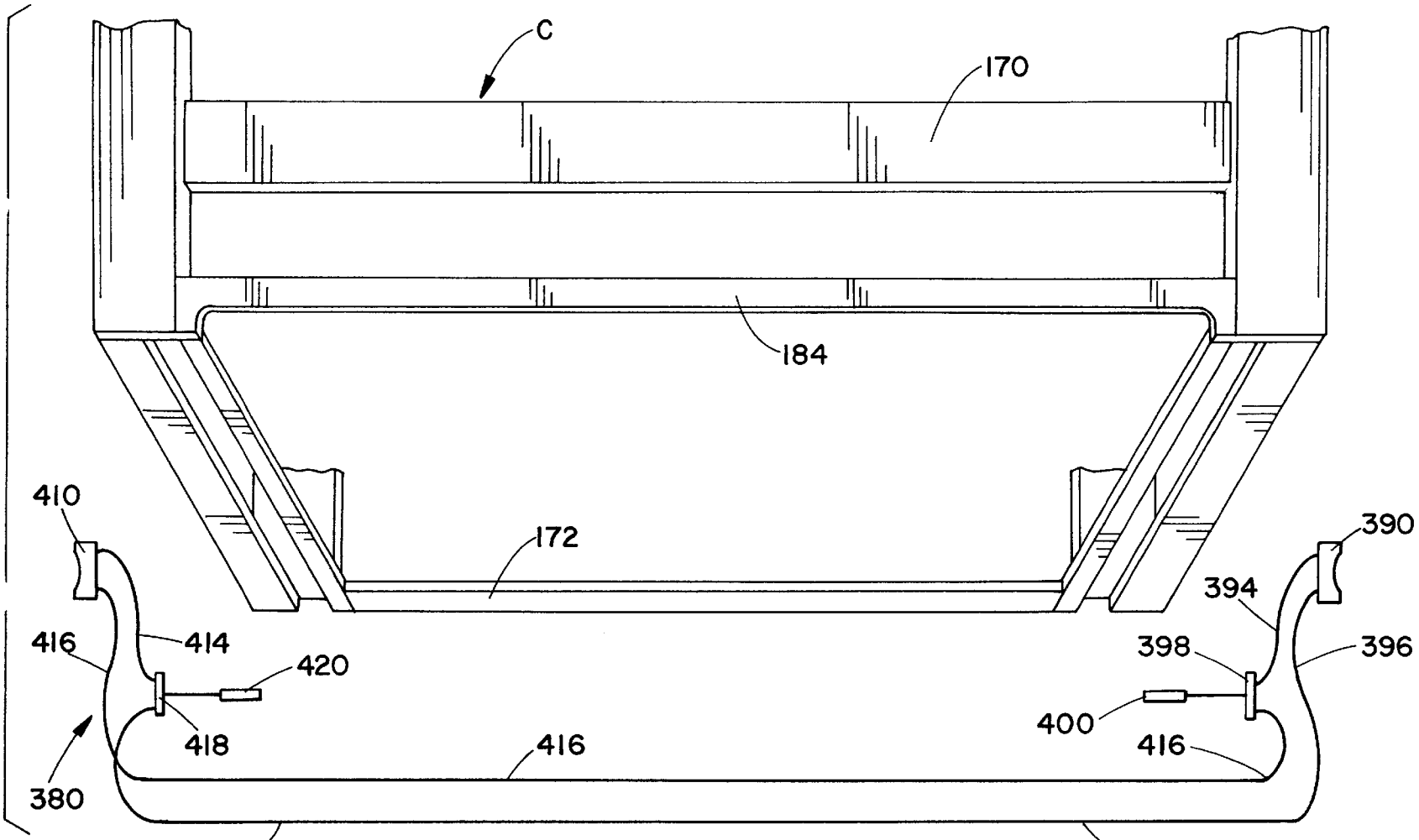
FIG. 27 is a partially exploded, perspective view of the third preferred embodiment sofa utilizing the first alternate actuation mechanism according to the present invention.

FIG. 27 is a partially exploded, perspective view of the third preferred embodiment sofa C utilizing the first alternate actuation mechanism 380. FIG. 27 more clearly illustrates the cable connection and configuration. It is to be understood that the use of the previously described dual cable control adapters and unique cable routing configuration enables simultaneous actuation of multiple latching assemblies from a single control knob. That is, both latching assemblies 400 and 420, located at opposite ends of the seating unit, may be simultaneously actuated at either end of the seating unit.

Figure 28:
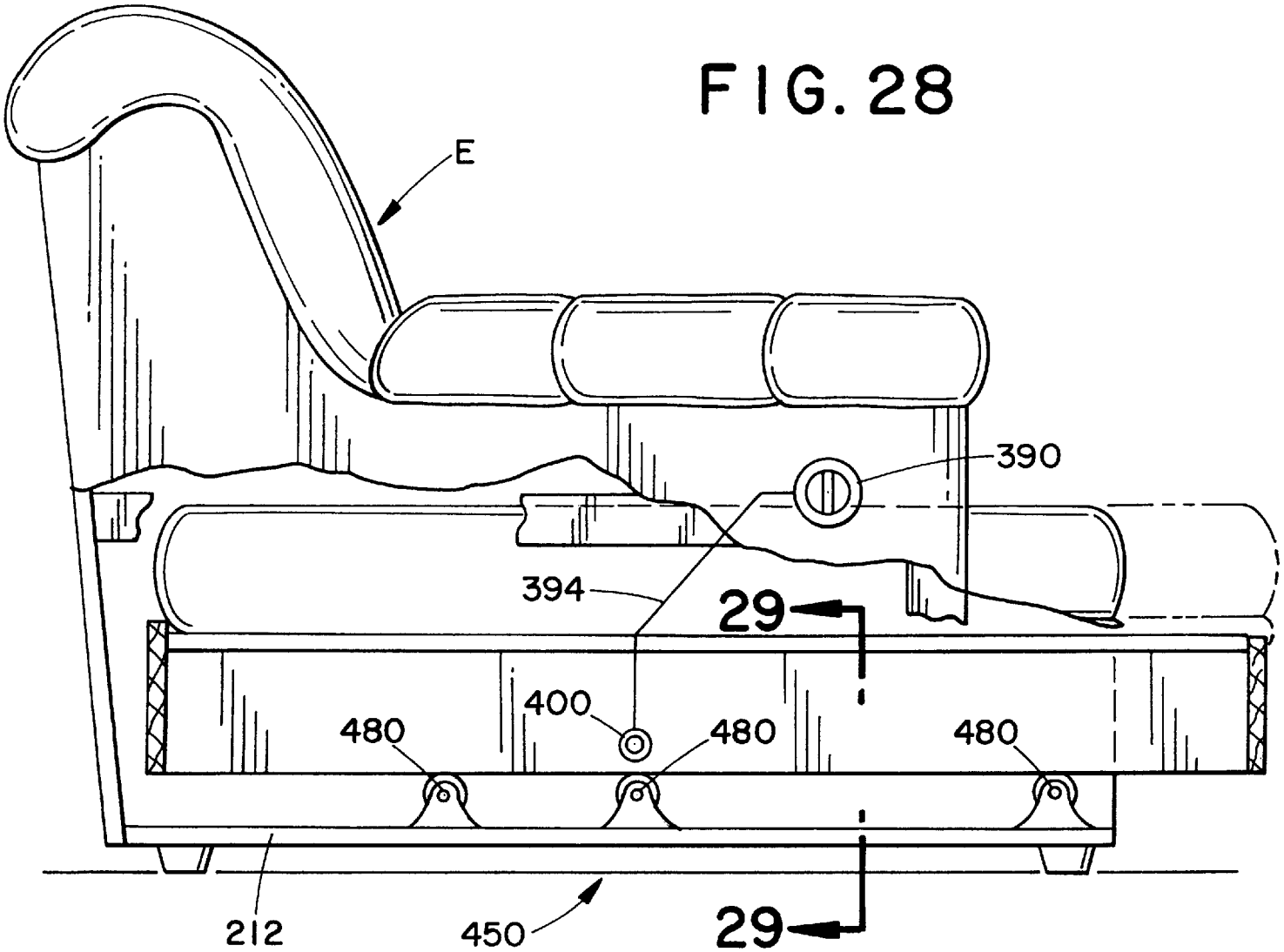
FIG. 28 is a side elevational view, partially broken away, of the fifth preferred embodiment sofa utilizing a second alternate frame assembly according to the present invention.

The present invention also provides a second alternate frame assembly 450, that can be incorporated in any of the seating units described herein. FIG. 28 illustrates the fifth embodiment sofa E utilizing the second alternate frame assembly 450 in accordance with the present invention. This second alternate frame assembly utilizes a plurality of caster rollers that facilitate extension or retraction of the seat within the seating unit. FIG. 28 also illustrates the first control knob 390 and its associated first side direct cable 394 in operable engagement with the first side latching assembly 400.

Figure 29:
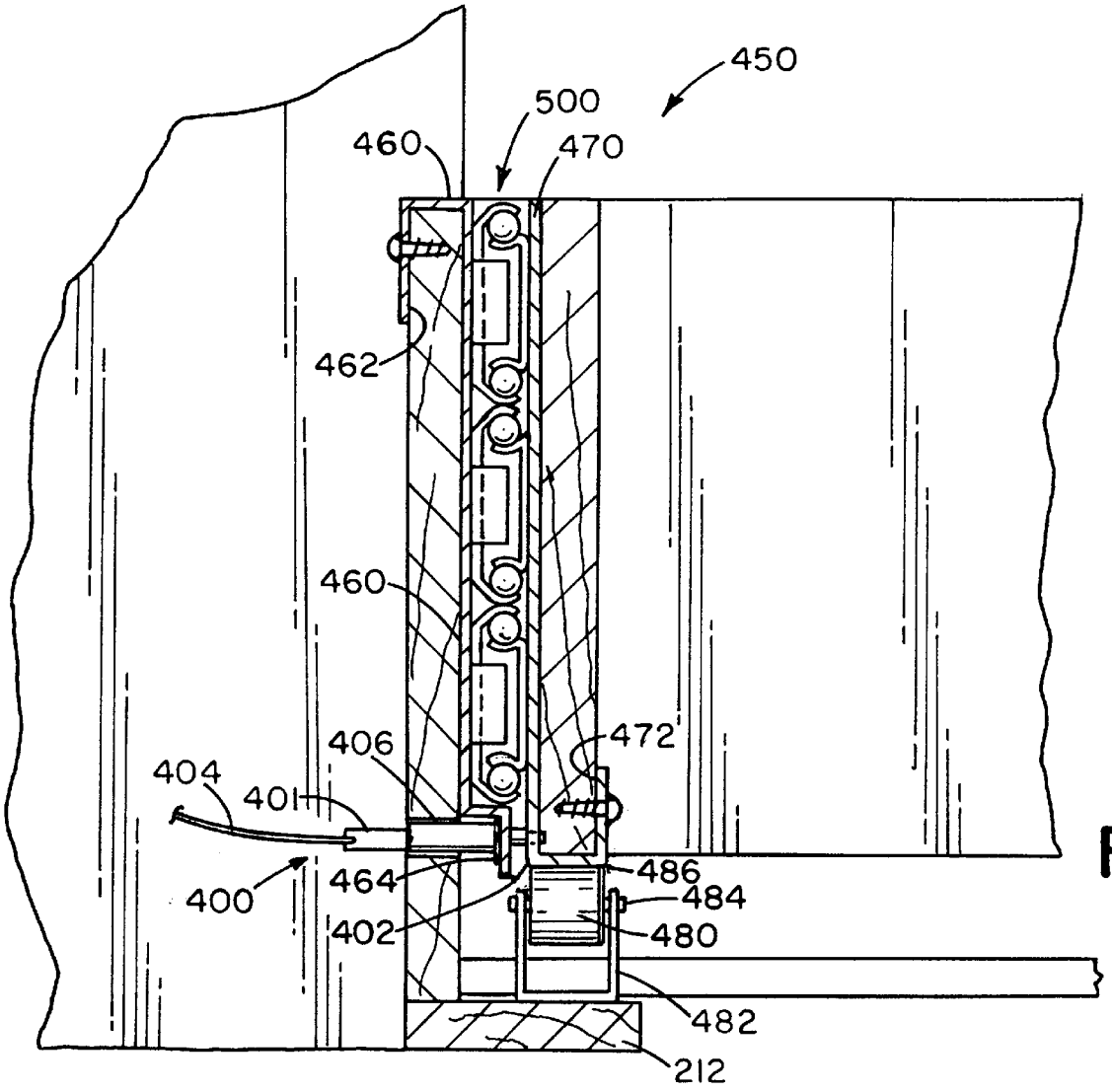
FIG. 29 is a partial cross-sectional view taken along line 29—29 in FIG. 28, illustrating in greater detail the second alternate frame assembly according to the present invention.

FIG. 29 is a partial cross-sectional view taken along line 29—29 in FIG. 28, illustrating in greater detail the second alternate frame assembly 450. The frame assembly 450 comprises longitudinal front and rear frame members, similar to the frame members 352 and 350 of the previously described first alternate frame assembly 340. In place of, or in addition to, two transverse frame members 354, each disposed at opposite ends of the resulting assembly, such as shown in FIG. 21, the frame assembly 450 comprises a stationary arm side bracket 460 and a movable seat side bracket 470. The frame assembly 450 further comprises a plurality of caster rollers 480. The stationary bracket 460 is affixed or otherwise incorporated within the main frame of the seating unit such as along the arm side. The bracket 460 comprises a first end 462 and a second end 464. It may be preferred to form the first end 462 to more readily engage a frame or support member of the seating unit, such as is shown in FIG. 29. The movable bracket 470 also has a first end 472 and a second end.

Disposed between the brackets 460 and 470 is a roller glide assembly 500 that facilitates movement between the brackets 460 and 470 and members attached thereto, and maintains orientation and alignment of the movable seat section with the seating unit. In the embodiment shown in FIG. 29, each caster roller 480 is rotatably supported along a caster axle 484 by a caster carriage 482. The caster carriage 482 is stationary and preferably secured to one or more frame members of the seating unit. The caster roller 480 contacts a caster race 486 defined along the underside of the first end 472 of the movable bracket 470. It is also preferred to secure or otherwise mount the latch assembly 400 to the stationary bracket 460, and preferably along the second end 464 of the bracket 460.

As described in greater detail below, one or more latching assemblies are utilized to releasably secure the movable seat at a desired location upon extension or retraction of the seat relative to the seating unit. The following description is given with regard to a latching assembly as utilized along the first side of the seating unit such as shown in FIG. 23. Referring further to FIG. 29, the first side latching assembly 400 comprises a latch pin 401 that releasably engages a first side latch rail 402. The latch rail 402 is secured to the movable seat portion. The latching assembly 400 further comprises the first side latch cable 404 secured to the latch pin 401, and a latch spring 406. The latch spring 406 urges the latch pin 401 into engagement with the latch rail 402. The latch pin 401 engages the latch rail 402 along a distal end of the pin 401. The pin 401 is linearly movable within a pin housing. A pin travel guide may also be utilized to facilitate movement of the pin within the housing, and most preferably maintain alignment and orientation of the pin within the pin housing. Details of the components and their configuration within the latching assembly 400 are described in greater detail below in conjunction with FIGS. 36–38.

Figure 30:
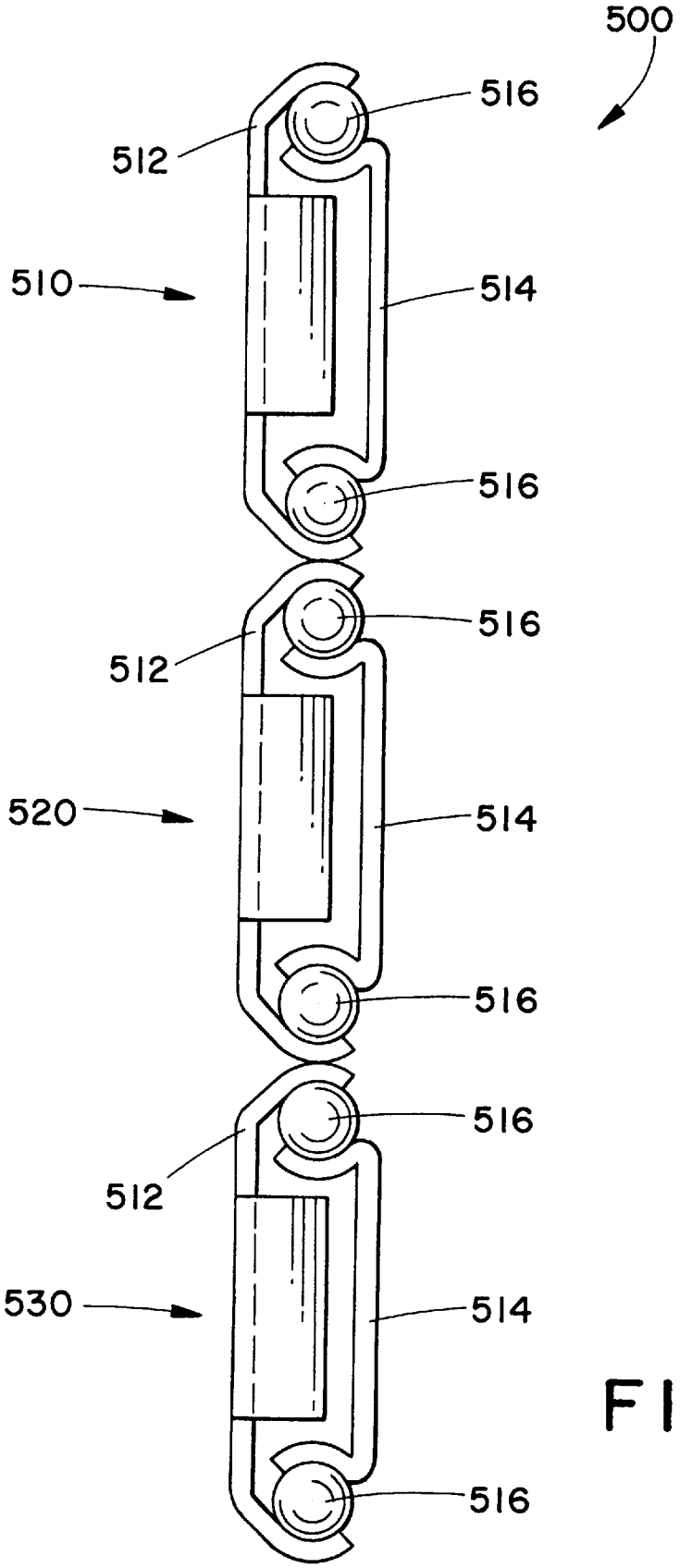
FIG. 30 is an end view of a roller glide assembly utilized in the second alternate frame assembly according to the present invention.

FIG. 30 illustrates the roller glide assembly 500 as used in the second alternate frame assembly 450. The roller glide assembly 500 comprises a first roller portion 510, a second roller portion 520, and a third roller portion 530. Each roller portion comprises an outer track 512, an inner nested or telescoping track 514. One or more bearings 516 facilitate movement between the tracks 512 and 514. The portions 510, 520, and 530 are preferably configured so that each portion extends concurrently and in parallel with the other portions. The use of such an arrangement of roller portions, that is, in a multiple and parallel configuration, significantly increases the load bearing capacity of the movable seat portion. The present invention includes other configurations for the roller portions 510, 520, and 530. For example, the portions can be arranged and operably engaged with each other so that only upon full or near extension between tracks 512 and 514 of one of the portions, such as the first roller portion 510, does extension occur between another set of tracks 512 and 514 of one or both of the other portions, such as the second roller portion 520.

Figure 31:
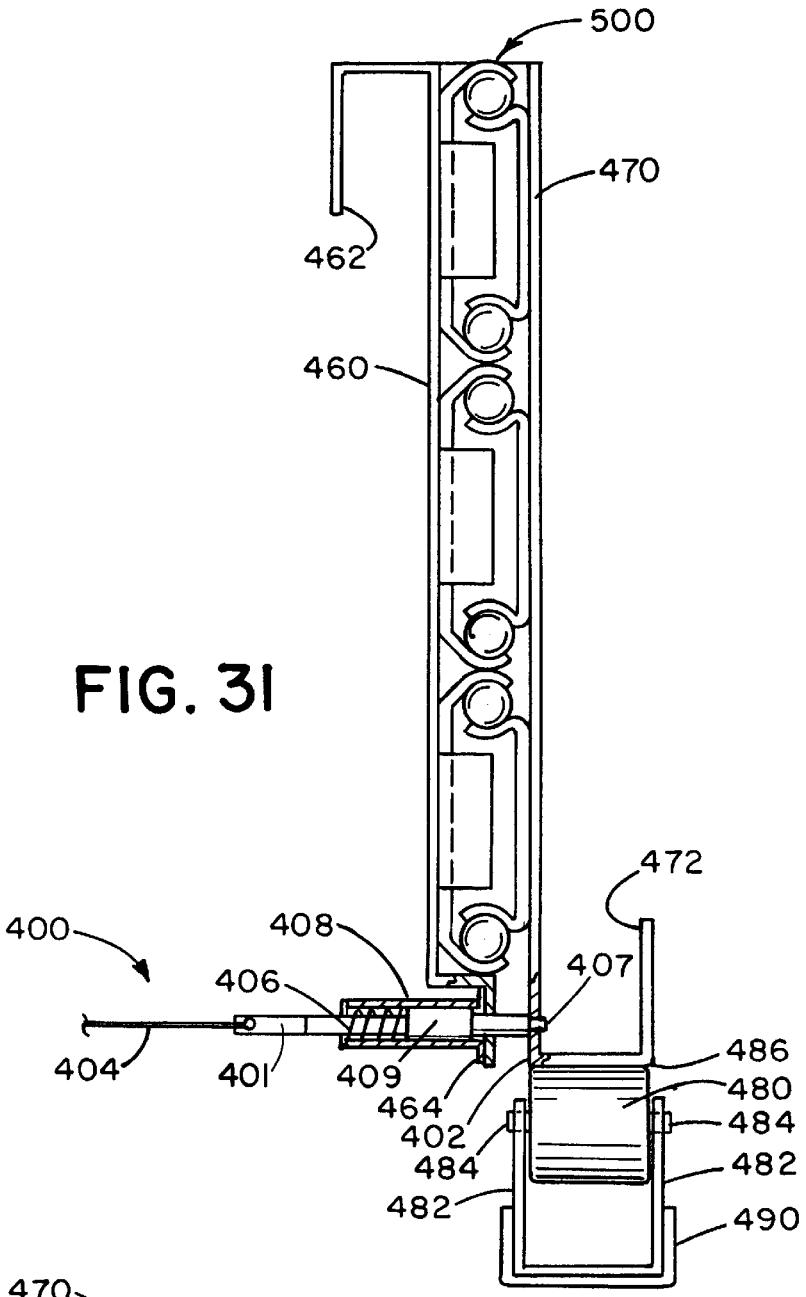
FIG. 31 illustrates in greater detail the roller glide assembly depicted in FIG. 30, a latching pin assembly, and a caster roller assembly employed in the second alternate frame assembly according to the present invention.

FIG. 31 illustrates in greater detail the roller glide assembly 500, latching pin assembly 400, and caster roller assembly employed in the second alternate frame assembly 450 according to the present invention. Upon actuation of a control knob, such as the control knob 390, and pulling or tensioning of cable 404, the latch pin 401 is linearly displaced away from the latch rail 402 until the distal end 407 of the latch pin 401 is disengaged from the latch rail 402. This action compresses the latch spring 406. Although a wide array of configurations may be used for the latch rail, it is preferred to utilize a rail or planar member having a plurality of spaced apertures defined along its length that are each sized to receive and engage the distal end of the latch pin. Once freed, the seat may then be moved, i.e. retracted or extended. Movement of the seat results in movement of the seat side bracket 470. Movement of the bracket 470 is facilitated by the glider assembly 500 and by one or more caster rollers 480. Upon release of the control knob, the spring 406, under compression, urges the pin 401 into engagement with the latch rail 402 to prevent further movement.

Figure 32:
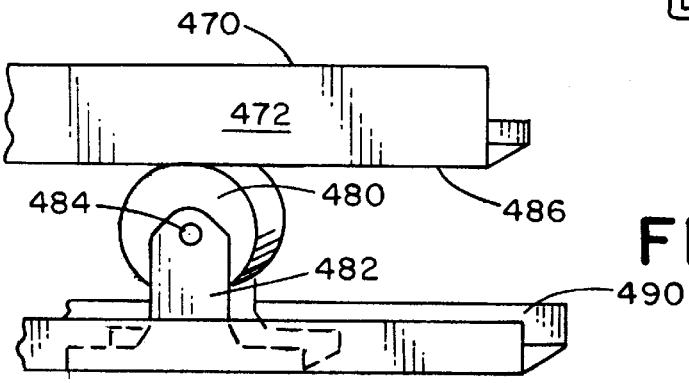
FIG. 32 is a partial side elevational view of the caster roller assembly illustrated in FIG. 31.

FIG. 32 is a partial side elevational view of the caster roller assembly illustrated in FIG. 31. In this configuration, movement of the seat causes movement of the seat side bracket 470. The caster 480 and caster carriage 482 are secured to a stationary support bracket 490. Movement of the seat side bracket 470 is facilitated by the caster roller 480 rotating along and contacting the caster race 486 defined along the underside of the bracket 470.

Figure 33:
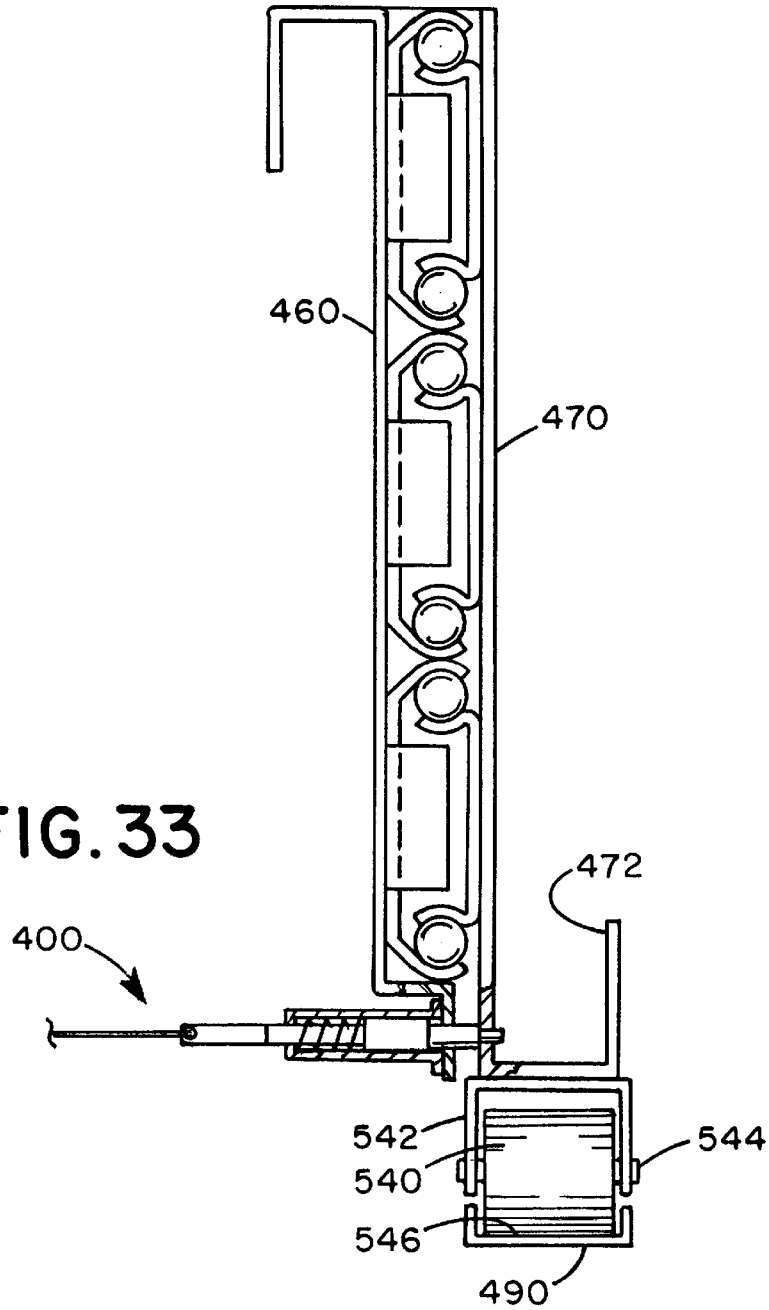
FIG. 33 illustrates the second alternate frame assembly depicted in FIG. 31 utilizing a second version of a caster roller assembly according to the present invention.
Figure 34:
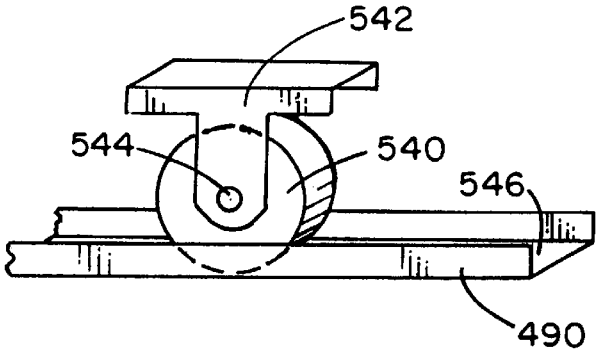
FIG. 34 is a partial side elevational view of the second version caster roller assembly shown in FIG. 33.

FIGS. 33 and 34 illustrate the second alternate frame assembly 450 utilizing a second version of a caster roller assembly according to the present invention. This second caster roller version utilizes a downwardly extending caster carriage 542 for housing a caster roller 540 along a rotatable axle 544. In this version, the caster carriage 542 is affixed to the lower region 472 of the movable seat side bracket 470. The caster roller 540 contacts a caster race 546 defined along an upwardly facing surface of a support bracket 490 which is stationary. It may be desirable to provide one or more upwardly projecting side walls alongside the caster race 546 to promote alignment between the seat frame and the seating unit as the seat is extended or retracted in relation to the stationary support bracket 490. It is to be understood that similar sidewalls could be provided along the caster race 486 of the first caster roller assembly version shown in FIGS. 31 and 32.

Figure 35:
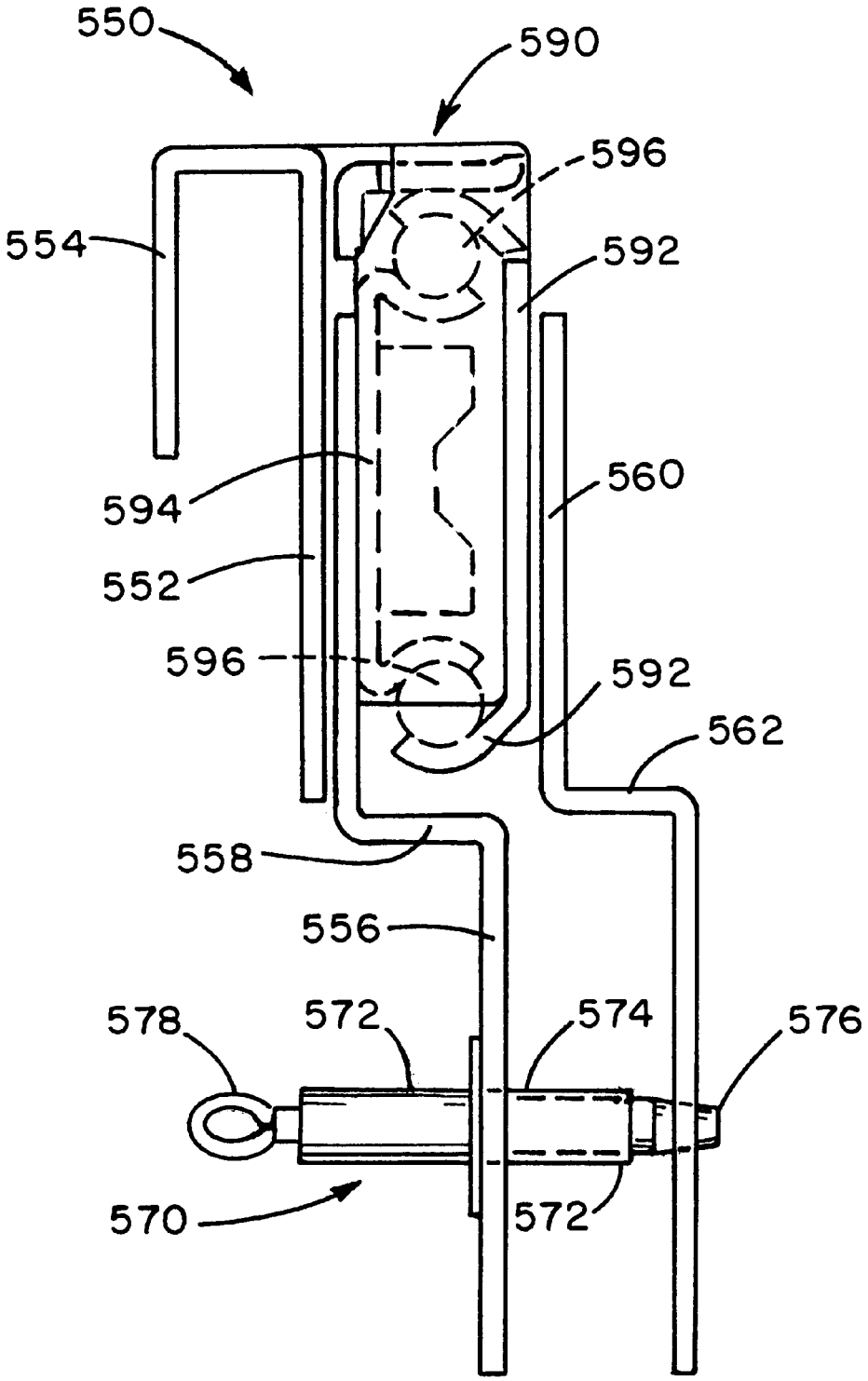
FIG. 35 is an end view of a third alternate frame assembly utilizing another roller glide assembly and yet another latching pin assembly according to the present invention.

The present invention further provides a third alternate frame assembly 550 as shown in FIG. 35. The frame assembly 550 comprises an upper stationary bracket 552, a lower stationary bracket 556, and a movable seat side bracket 560. The stationary bracket 552 has an upper end 554 adapted to be incorporated within or affixed to a portion of the main frame of the seating unit. The lower stationary bracket 556 includes a transverse portion 558 that preferably extends horizontally between an upper end of the lower stationary bracket 556 and a lower portion of that bracket. Similarly, the movable bracket 560 includes a transverse portion 562. It is contemplated that a single bracket could be utilized instead of the upper and lower brackets 552 and 556. A latching assembly is also used in conjunction with the frame assembly 550. The latching assembly may be similar to that latching assembly 400 previously described or may be as follows and in accordance with an alternate latching assembly 570. This alternate latching assembly 570 comprises a latch housing 572 preferably extending between the lower portions of the lower stationary bracket 556 and proximate to the movable seat side bracket 560. The latching assembly 570 further comprises a latch pin 574 movably disposed within the latch housing 572 and having a latch pin engaging end 576 and a latch pin actuating end 578. The frame assembly 550 further comprises a roller glide assembly 590 comprising an outer track 592, an inner track 594, and a plurality of bearings 596 that facilitate movement, preferably telescoping movement, between the tracks 592 and 594. The assembly enables the seat side bracket 560 to be moved, or linearly displaced, relative to the stationary brackets 552 and 556.

Figure 36:
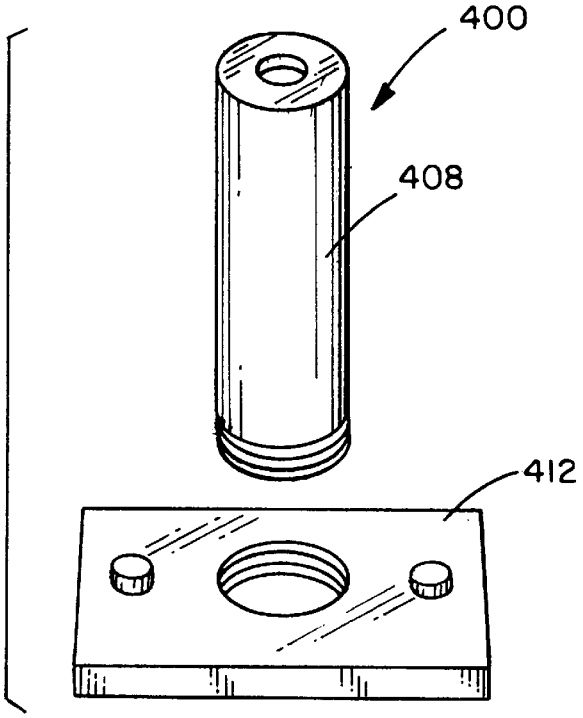
FIG. 36 illustrates in greater detail engagement of the latching pin assembly shown in FIG. 31.
Figure 37:
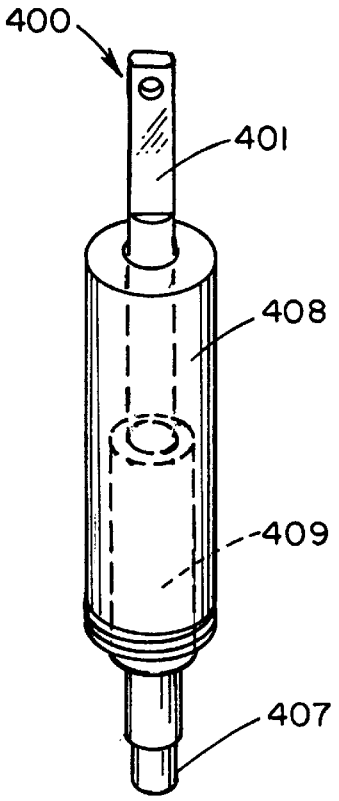
FIG. 37 is a perspective view of the latching pin assembly depicted in FIG. 36.
Figure 38:
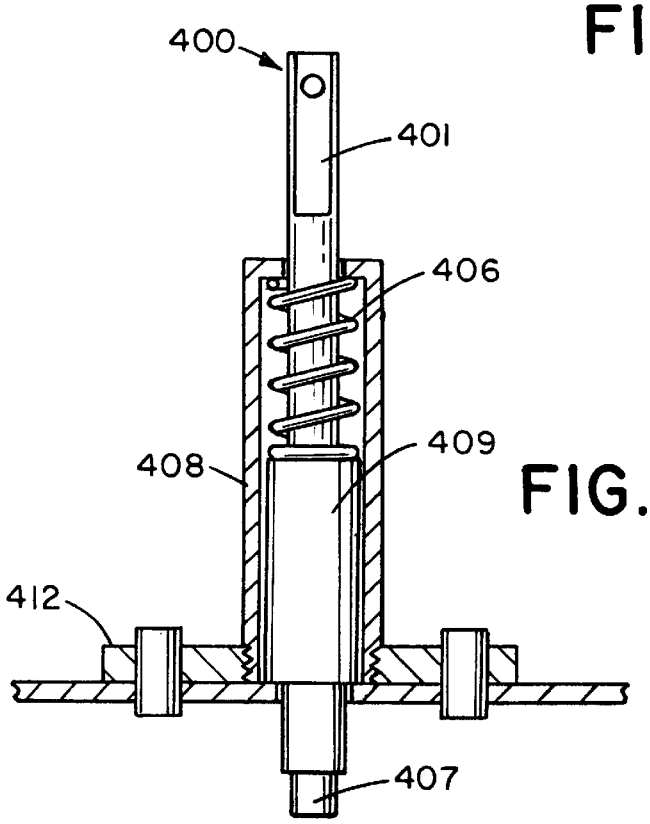
FIG. 38 is a cross-sectional view of the latching pin assembly shown in FIG. 36.

FIGS. 36, 37 and 38, further illustrate the previously noted latching assembly 400. As shown in FIG. 36, the latching assembly 400 comprises a pin housing 408 and a support plate 412. Referring to FIG. 37, the support plate 412 may be secured to the lower region 464 of the stationary bracket 460. The pin housing 408 is preferably a hollow cylindrical body having a threaded end for releasably engaging a corresponding threaded aperture defined in the support plate 412. As shown in FIG. 37, the latch pin 401 is disposed within a cylindrical bore in the pin housing 408. The latch pin 401 extends through the housing 408 so that the engaging distal end 407 of the pin extends out the other end of the housing 408. Optionally, a pin travel guide 409 may be utilized within the housing 408 to facilitate movement and maintain alignment of the pin 401 within the housing 408. FIG. 38 illustrates a cross-sectional view of the latching assembly 400. A latch spring 406 is disposed within the housing 408 between the pin travel guide 409 and end of the housing 408.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof. Moreover, it will be understood that features of a previously described preferred embodiment may be utilized in any of the other preferred embodiments described herein.

I claim:

1. A seating unit with a movable seat section, comprising:

a main frame arranged for support of a backrest;

a seat frame for supporting a seat;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame;

a latching assembly for securing said seat frame in relation to said main frame in a plurality of positions between said retracted position and said extended position; and a plurality of legs affixed to said seat frame and extending downwardly therefrom, wherein said legs are movable with said seat frame and provide support therefor.

2. A seating unit with a movable seat section comprising:

a main frame arranged for support of a backrest;

a seat frame for supporting a seat;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame;

a latching assembly for securing said seat frame in relation to said main frame in a plurality of positions between said retracted position and said extended position;

an actuation assembly for enabling movement between said main frame and said seat frame, said actuation assembly comprising (i) a first actuator disposed at a first end of said seating unit, (ii) a second actuator disposed at a second end of said seating unit, (iii) a first control adapter operably connected to said latching assembly and both said first actuator and said second actuator, and (iv) a second control adapter operably connected to said latching assembly and both said first actuator and said second actuator, wherein said first control adapter and said second control adapter actuate said latching assembly to release said seat frame relative to said main frame and thereby enable movement of said seat frame, upon actuation of either said first actuator or said second actuator; and a plurality of legs affixed to said seat frame and extending downwardly therefrom, wherein said leas are movable with said seat frame and provide support therefor.

3. A seating unit with a movable seat section, comprising:

a main frame arranged for support of a backrest;

a seat frame for supporting a seat;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame;

a latching assembly for securing said seat frame in relation to said main frame in a plurality of positions between said retracted position and said extended position, wherein said latching assembly includes: a latch pin housing secured to at least one of said main frame or said first member of said support track, said latch pin housing adapted to retain a movable latch pin; a latch rail secured to said seat frame, said rail defining a plurality of spaced apertures, each said aperture sized to engage a latch pin; a latch pin retained by said latch pin housing and movable between a first position in which said latch pin is engaged with one of said apertures defined in said latch rail, and a second position in which said latch pin is disengaged from said latch rail; and a spring in operable engagement with said latch pin, wherein upon movement of said latch pin to said second position, said spring is compressed and said seat frame may be moved relative to said main frame; and a plurality of legs affixed to said seat frame and extending downwardly therefrom, wherein said legs are movable with said seat frame and provide support therefor.

4. The seating unit of claim 3 further comprising:

an actuation assembly for enabling movement between said main frame and said seat frame, said actuation assembly comprising (i) a first actuator, (ii) a second actuator, (iii) a first control adapter operably connected to said latching assembly and both said first actuator and said second actuator, and (iv) a second control adapter operably connected to said latching assembly and both said first actuator and said second actuator, wherein said first control adapter and said second control adapter actuate said latching assembly to release said seat frame relative to said main frame and thereby enable movement of said seat frame, upon actuation of either of said first actuator or said second actuator.

5. The seating unit of claim 4 wherein said actuation assembly further comprises (v) a first plurality of cables for operably connecting said first control adapter to said first actuator and said second actuator, and (vi) a second plurality of cables for operably connecting said second control adapter to said first actuator and said second actuator.

6. A seating unit with a movable seat section, comprising:

a main frame arranged for support of a backrest;

a seat frame for supporting a seat;

a support track for movably supporting said seat frame on said main frame, said support track comprising a first member affixed to said main frame and a second member affixed to said seat frame, wherein said first member cooperates with said second member for moving said seat frame from a retracted position to an extended position in relation to said main frame; and a latching assembly for securing said seat frame in relation to said main frame in a plurality of positions between said retracted position and said extended position, said latching assembly comprising (i) a latch pin retainer secured to at least one of said main frame or said first member of said support track, said latch pin retainer adapted to retain a movable latch pin, (ii) a latch rail secured to said seat frame, said rail defining a plurality of spaced apertures, (iii) a latch pin retained by said latch pin retainer and movable between a first position in which said latch pin is engaged with one of said apertures defined in said latch rail, and a second position in which said latch pin is disengaged from said latch rail, and (iv) a spring in operable engagement with said latch pin, wherein upon movement of said latch pin to said second position, said spring is compressed and said seat frame may be moved relative to said main frame.

7. A seating unit with a movable seat section, comprising:

a main frame for support of a backrest;

a seat frame for supporting a seat;

a support track for movably supporting said seat frame on said main frame, said support track comprising a first member secured to said main frame and a second member secured to said seat frame, wherein said first member cooperates with said second member for moving said seat frame from a retracted position to an extended position in relation to said main frame;

a latching assembly for securing said seat frame in relation to said main frame in a plurality of positions between said retracted position and said extended position;

an actuation assembly for enabling movement between said main frame and said seat frame, said actuation assembly comprising (i) a first actuator disposed at a first end of said seating unit, (ii) a second actuator disposed at a second end of said seating unit, (iii) a first control adapter operably connected to said latching assembly and both said first actuator and said second actuator, and (iv) a second control adapter operably connected to said latching assembly and both said first actuator and said second actuator, wherein said first control adapter and said second control adapter actuate said latching assembly to release said seat frame relative to said main frame and thereby en able movement of said seat frame, upon actuation of either said first actuator or said second actuator; and a caster assembly comprising at least one caster affixed to one of said seat frame and said main frame, and a caster race defined on the other of said seat frame and said main frame.

8. A seating unit with a movable seat section, comprising:

a main frame for support of a backrest;

a seat frame for supporting a seat;

a support track for movably supporting said seat frame on said main frame, said support track comprising a first member secured to said main frame and a second member secured to said seat frame, wherein said first member cooperates with said second member for moving said seat frame from a retracted position to an extended position in relation to said main frame;

a latching assembly for securing said seat frame in relation to said main frame in a plurality of positions between said retracted position and said extended position, wherein said latching assembly includes:

a latch pin housing secured to at least one of said main frame or said first member of said support track, said latch pin housing adapted to retain a movable latch pin;

a latch rail secured to said seat frame, said rail defining a plurality of spaced apertures, each said aperture sized to engage a latch pin;

a latch pin retained by said latch pin housing and movable between a first position in which said latch pin is engaged with one of said apertures defined in said latch rail, and a second position in which said latch pin is disengaged from said latch rail; and a spring in operable engagement with said latch pin, wherein upon movement of said latch pin to said second position, said spring is compressed and said seat frame may be moved relative to said main frame; and a caster assembly comprising at least one caster affixed to one of said seat frame and said main frame, and a race defined on the other of said seat frame and said main frame.

9. The seating unit of claim 8 further comprising:

an actuation assembly for enabling movement between said main frame and said seat frame, said actuation assembly comprising (i) a first actuator, (ii) a second actuator, (iii) a first control adapter operably connected to said latching assembly and both said first actuator and said second actuator, and (iv) a second control adapter operably connected to said latching assembly and both said first actuator and said second actuator, wherein said first control adapter and said second control adapter actuate said latching assembly to release said seat frame relative to said main frame and thereby enable movement of said seat frame, upon actuation of either said first actuator or said second actuator.

10. The seating unit of claim 9 wherein said actuation assembly further comprises (v) a first plurality of cables for operably connecting said first control adapter to said first actuator and said second actuator, and (vi) a second plurality of cables for operably connecting said second control adapter to said first actuator and said second actuator.

11. A seating unit with a movable seat section, said seating unit having a first end and a second end, and comprising:

a stationary main frame;

a backrest affixed to said main frame;

a seat frame movable with respect to said main frame, and independently movable with respect to said backrest;

a locking assembly for securing and releasing said seat frame relative to said main frame; and an actuation assembly for enabling movement between said main frame and said seat frame, said actuation assembly comprising (i) a first actuator disposed at said first end of said seating unit, (ii) a second actuator disposed at said second end of said seating unit, (iii) a first control adapter operably connected to said locking assembly and both said first actuator and said second actuator, and (iv) a second control adapter operably connected to said locking assembly and both said first actuator and said second actuator, wherein said first control adapter and said second control adapter actuate said locking assembly to release said seat frame relative to said main frame and thereby enable movement of said seat frame, upon actuation of either said first actuator or said second actuator.

12. A seating unit with a movable seat section, said seating unit having a first end and a second end, and comprising:

a main frame;

a seat frame movable with respect to said main frame;

a locking assembly for securing and releasing said seat frame relative to said main frame; and an actuation assembly for enabling movement between said main frame and said seat frame, said actuation assembly comprising (i) a first actuator located at said first end of said seating unit, (ii) a second actuator located at said second end of said seating unit, (iii) a first control adapter operably connected to said locking assembly and both said first actuator and said second actuator, (iv) a second control adapter operably connected to said locking assembly and both said first actuator and said second actuator, (v) a first latch cable for operably connecting said first control adapter to said locking assembly, and (vi) a second latch cable for operably connecting said second control adapter to said locking assembly, wherein said first control adapter and said second control adapter actuate said locking assembly to release said seat frame relative to said main frame and thereby enable movement of said seat frame, upon actuation of either said first actuator or said second actuator.

13. A seating unit with a movable seat section, said seating unit having a first end and a second end, and comprising:

a stationary main frame;

a seat frame movable with respect to said main frame;

a latching assembly for securing and releasing said seat frame relative to said main frame, said latching assembly comprising (i) a pin housing secured to said main frame and adapted to retain a movable pin, (ii) a latch rail defining a plurality of spaced apertures, each said aperture sized to engage a pin, said rail secured to said seat frame, and (iii) a pin retained by said pin housing and movable between a first position in which said pin engages one of said apertures and a second position in which said pin disengages from said rail, wherein upon actuation of said latching assembly by said first control adapter and said second control adapter, said pin moves from said first position to said second position, thereby enabling movement of said seat frame; and an actuation assembly for enabling movement between said main frame and said seat frame, said actuation assembly comprising (i) a first actuator disposed at said first end of said seating unit, (ii) a second actuator disposed at said second end of said seating unit, (iii) a first control adapter operably connected to said latching assembly and both said first actuator and said second actuator, and (iv) a second control adapter operably connected to said latching assembly and both said first actuator and said second actuator, wherein said first control adapter and said second control adapter actuate said latching assembly to release said seat frame relative to said main frame and thereby enable movement of said seat frame, upon actuation of either said first actuator or said second actuator.

14. A seating unit with a movable seat section, comprising:

a main frame arranged for support of a backrest;

a backrest affixed to said main frame;

a seat frame for supporting a seat;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame, and said seat frame moves independently of said backrest; and a latching assembly for securing said seat frame in relation to said main frame in a plurality of positions between said retracted position and said extended position.

15. The seating unit of claim 14 further comprising at least one roller glide assembly secured to said seat frame and said main frame for slidably mounting said seat frame to said main frame.

16. A seating unit with a movable seat section, comprising:

a main frame arranged for support of a backrest;

a backrest affixed to said main frame;

a seat frame for supporting a seat;

a support track for movably supporting said seat frame on said main frame, said support track comprising a first member fixed to said main frame and a second member fixed to said seat frame, wherein said first member cooperates with said second member for moving said seat frame from a retracted position to an extended position in relation to said main frame, and said seat frame moves independently from said backrest;

a latching assembly for securing said seat frame in relation to said main frame in a plurality of positions between said retracted position and said extended position; and a caster assembly comprising at least one caster wheel affixed to one of said seat frame and said main frame, and a caster race defined on the other of said seat frame and said main frame.

17. The seating unit of claim 16, wherein said at least one caster wheel is affixed to said main frame and said caster race is defined on a portion of said seat frame.

18. The seating unit of claim 16 wherein said at least one caster wheel is affixed to said seat frame and said caster race is defined on a portion of said main frame.

19. A seating unit with a movable seat section, said seating unit having a first end and a second end, and comprising:

a main frame;

a seat frame movable with respect to said main frame;

a locking assembly for securing and releasing said seat frame relative to said main frame; and an actuation assembly for enabling movement between said main frame and said seat frame, said actuation assembly comprising (i) a first actuator disposed at said first end of said seating unit, (ii) a second actuator disposed at said second end of said seating unit, (iii) a first control adapter operably connected to said locking assembly and both said first actuator and said second actuator, (iv) a second control adapter operably connected to said locking assembly and both said first actuator and said second actuator, (v) a first plurality of cables for operably connecting said first control adapter to said first actuator and said second actuator, and (vi) a second plurality of cables for operably connecting said second control adapter to said first actuator and said second actuator, wherein said first control adapter and said second control adapter actuate said locking assembly to release said seat frame relative to said main frame and thereby enable movement of said seat frame, upon actuation of either said first actuator or said second actuator.

20. The seating unit of claim 19 wherein said first control adapter is disposed proximate said first end of said seating unit and said second control adapter is disposed proximate said second end of said seating unit, said first plurality of cables comprising a first side direct cable extending between said first actuator and said first control adapter, and a first side remote cable extending between said first actuator and said second control adapter, said second plurality of cables comprising a second side direct cable extending between said second actuator and said second control adapter, and a second side remote cable extending between said second actuator and said first control adapter.

* * * * *